US009520249B2

(12) United States Patent
Bonavides

(10) Patent No.: US 9,520,249 B2
(45) Date of Patent: Dec. 13, 2016

(54) CHANGING THE STATE OF A SWITCH THROUGH THE APPLICATION OF POWER

(75) Inventor: Clovis Satyro Bonavides, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 317 days.

(21) Appl. No.: 14/119,310

(22) PCT Filed: Oct. 11, 2011

(86) PCT No.: PCT/US2011/055729

§ 371 (c)(1),
(2), (4) Date: Nov. 21, 2013

(87) PCT Pub. No.: WO2012/166192

PCT Pub. Date: Dec. 6, 2012

(65) Prior Publication Data

US 2014/0185178 A1 Jul. 3, 2014

Related U.S. Application Data

(63) Continuation-in-part of application No. PCT/US2011/038900, filed on Jun. 2, 2011.

(51) Int. Cl.
*H01H 5/04* (2006.01)
*H01H 85/46* (2006.01)
(Continued)

(52) U.S. Cl.
CPC ..... *H01H 5/04* (2013.01); *H01H 3/30* (2013.01); *H01H 37/76* (2013.01); *H01H 37/761* (2013.01);
(Continued)

(58) Field of Classification Search
CPC ..... H01H 5/04; H01H 85/46; H01H 37/76; H01H 37/767; H01H 61/04; H01H 61/02; H01H 85/36; H01H 37/761; H01H 3/30; H01H 2037/762; H01H 2037/763; F42C 15/40; F42C 19/00; F42C 15/36
(Continued)

(56) References Cited

U.S. PATENT DOCUMENTS 2,344,173 A 3/1944 Ruge
3,168,141 A 2/1965 Lebourg
(Continued)

FOREIGN PATENT DOCUMENTS

CN 1030824 A 2/1989
CN 101389826 A 3/2009
(Continued)

OTHER PUBLICATIONS

International Searching Authority, International Search Report and the Written Opinion of the International Searching Authority in PCT/US2012/035338, Aug. 3, 2012.
(Continued)

*Primary Examiner* — Anatoly Vortman
(74) *Attorney, Agent, or Firm* — Howard L. Speight, PLLC

(57) ABSTRACT

A switch includes a spring. The switch further includes a collapsing element. The spring has a first spring state in which it is being held in tension by a restraining element and a second spring state in which it is not being held in tension because the restraining element has failed. The collapsing element is situated such that when sufficient power is applied to the collapsing element heat from the collapsing element will cause the restraining element to fail. The switch further includes a first contact coupled to the spring. The switch further includes a second contact coupled to the spring. The first contact and the second contact have a first 1-2 electrical connection state when the spring is in the first spring state.
(Continued)

The first contact and the second contact have a second 1-2 electrical connection state different from the first 1-2 electrical connection state when the spring is in the second spring state.

19 Claims, 18 Drawing Sheets

(51) Int. Cl.

| | |
|---|---|
| ***H01H 85/36*** | (2006.01) |
| ***H01H 3/30*** | (2006.01) |
| ***H01H 61/02*** | (2006.01) |
| ***H01H 61/04*** | (2006.01) |
| *H01H 37/76* | (2006.01) |
| *F42C 15/36* | (2006.01) |
| *F42C 15/40* | (2006.01) |
| *F42C 19/00* | (2006.01) |

(52) U.S. Cl.
CPC ..... *H01H 37/767* (2013.01); *H01H 61/02* (2013.01); *H01H 61/04* (2013.01); *H01H 85/36* (2013.01); *H01H 85/46* (2013.01); *F42C 15/36* (2013.01); *F42C 15/40* (2013.01); *F42C 19/00* (2013.01); *H01H 2037/762* (2013.01); *H01H 2037/763* (2013.01)

(58) Field of Classification Search
USPC .... 337/4, 142, 147, 153, 154, 157, 401, 407
See application file for complete search history.

(56) References Cited

U.S. PATENT DOCUMENTS

| | | | | |
|---|---|---|---|---|
| 3,309,481 | A | 3/1967 | Merrill | |
| 3,676,945 | A | 7/1972 | Neanhouse | |
| 3,717,095 | A | 2/1973 | Vann | |
| 4,047,143 | A * | 9/1977 | Burden | H01H 85/36 337/239 |
| 4,099,818 | A | 7/1978 | Meinzer | |
| 4,124,835 | A * | 11/1978 | Cahill, Jr. | G01R 11/00 337/1 |
| 4,151,383 | A | 4/1979 | Miyata | |
| 4,186,366 | A * | 1/1980 | McVey | H01H 37/766 337/407 |
| 4,288,833 | A * | 9/1981 | Howell | H02H 9/06 337/16 |
| 4,808,960 | A * | 2/1989 | Nixon | H01H 61/02 337/102 |
| 4,821,010 | A * | 4/1989 | Plasko | H01H 61/02 337/183 |
| 4,869,170 | A | 9/1989 | Dahmberg et al. | |
| 4,927,988 | A | 5/1990 | Nolte | |
| 5,014,036 | A * | 5/1991 | Komoto | H01H 9/102 337/4 |
| 5,105,742 | A | 4/1992 | Sumner | |
| 5,115,865 | A | 5/1992 | Carisella et al. | |
| 5,831,507 | A * | 11/1998 | Kasamatsu | H01H 9/10 337/299 |
| 5,839,508 | A | 11/1998 | Tubel et al. | |
| 5,908,365 | A | 6/1999 | Lajaunie et al. | |
| 5,967,297 | A | 10/1999 | Kaufman et al. | |
| 6,070,672 | A | 6/2000 | Gazda | |
| 6,741,159 | B1 * | 5/2004 | Kuczynski | H01H 37/002 337/142 |
| 7,345,568 | B2 * | 3/2008 | Yu | H01H 37/002 337/13 |
| 7,387,162 | B2 | 6/2008 | Mooney, Jr. et al. | |
| 8,432,246 | B2 * | 4/2013 | Suzuki | H01H 9/12 200/61.08 |
| 2001/0027864 | A1 | 10/2001 | Vaynshteyn | |
| 2003/0213595 | A1 | 11/2003 | Jackson | |
| 2005/0128043 | A1 * | 6/2005 | Ying | H01H 9/32 337/36 |
| 2007/0207669 | A1 | 9/2007 | Hummel et al. | |
| 2009/0316319 | A1 * | 12/2009 | Depping | H01C 7/126 361/91.1 |
| 2010/0245022 | A1 * | 9/2010 | Galla | H01H 37/761 337/159 |
| 2012/0068806 | A1 * | 3/2012 | Guarniere | H01C 7/10 337/1 |
| 2012/0194315 | A1 * | 8/2012 | Matthiesen | H01H 37/761 337/142 |
| 2012/0229246 | A1 * | 9/2012 | Depping | H01C 7/12 337/114 |
| 2014/0185178 | A1 * | 7/2014 | Bonavides | F42C 15/36 361/115 |
| 2014/0345485 | A1 * | 11/2014 | Molina | E21B 43/1185 102/202.14 |

FOREIGN PATENT DOCUMENTS

| | | |
|---|---|---|
| CN | 1934406 B | 6/2011 |
| DE | G89C3566.6 | 10/1989 |
| EP | 0144660 A1 | 6/1985 |
| EP | 0931906 A2 | 7/1999 |

OTHER PUBLICATIONS

Australian Government IP Australia, Patent Examination Report No. 1, Patent Application No. 2013274760, Nov. 10, 2014.

European Patent Office, European Patent Publication, Electrical Connection Device, such as a Socket-Outlet, for Electrical Power-Consuming Devices, Publication Date: Jun. 19, 1985 which is a translation of EP0144660.

European Patent Office, European Search Report, Application No./Patent No. 11866905.0-1808/2697811 PCT/US2011055729 (which is the EP counterpart of the instant application), Oct. 28, 2014.

Federal Republic of Germany, German Patent Office, Electrical Switch, Publication date: Oct. 26, 1989 which is a translation of Gebrauchsmuster DE G C3 566.6.

USPTO, Notice of Allowance, Safely Deploying Power, Date Mailed: Sep. 29, 2014, U.S. Appl. No. 14/119,335, which is related to the instant application.

International Preliminary Examining Authority, International Preliminary Report on Patentability in PCT/US11/38900, Jun. 6, 2013.

International Preliminary Examining Authority, International Preliminary Report on Patentability in PCT/US2011/055729, Jun. 28, 2013.

International Preliminary Examining Authority, International Preliminary Report on Patentability in PCT/US2012/035338, Oct. 4, 2013.

International Searching Authority, International Search Report and the Written Opinion of the International Searching Authority in PCT/US2011/055729, Mar. 2, 2012.

International Searching Authority, International Search Report and the Written Opinion of the International Searching Authority in PCT/US2012/035338, Aug. 30, 2012.

International Searching Authority, International Search Report and the Written Opinion of the International Searching Authority in PCT/US2011/038900, Oct. 7, 2011.

The State Intellectual Property Office of the People's Republic of China, Notice on the First Office Action, Application/Patent No. 201180071340.8, which is a CN counterpart of the instant application, Apr. 17, 2015.

Translation of the argument in the the State Intellectual Property Office of the People's Republic of China, Application/Patent No. 201180071340.8, Notice on the First Office Action, which is a CN counterpart of the instant application, Apr. 17, 2015.

Translation of the non-argument portions of the State Intellectual Property Office of the People's Republic of China, Notice on the First Office Action, Application/Patent No. 201180071340.8, which is a CN counterpart of the instant application, Apr. 17, 2015.

(56) References Cited

OTHER PUBLICATIONS

Australian Government IP Australia, Notice of Grant, Patent No. 2011369375, which is an AU counterpart to the instant application, Feb. 11, 2016.
English translation of the State Intellectual Property Office of the People's Republic of China, Notice of Grant of Patent Right for Invention, Application/Patent No. 201180071340.8, which is a CN counterpart to the instant application, Jan. 4, 2016.
European Patent Office, Communication pursuant to Article 94(3) EPC, Application No. 11 866 905.0-1808, which is an EP counterpart to the instant application, Mar. 11, 2016.
The State Intellectual Property Office of the People's Republic of China, Notice of Grant of Patent Right for Invention, Application/Patent No. 201180071340.8, which is a CN counterpart to the instant application, Jan. 4, 2016, translation filed herewith.
Discovery House, Australian Government IP Australia, Notice of Acceptance, Application No. 2011369375, which is an AU counterpart of the instant application, Oct. 16, 2015.
The State of Intellectual Property Office of the People's Republic of China, Notice of the Second Office Action, Application/Patent No. 201180071340.8, which is a CN counterpart of the instant application, Oct. 21, 2015.
Translation of the State of Intellectual Property Office of the People's Republic of China, Notice of the Second Office Action, Application/Patent No. 201180071340.8, which is a CN counterpart of the instant application, Oct. 21, 2015.
United States Patent and Trademark Office, Notice of Non-Final Office Action, U.S. Appl. No. 14/119,294, which is a related US matter of the instant application, Nov. 25, 2015.
Canadian Intellectual Property Office, Notice of Allowance, Application No. 2,834,244, which is a CA counterpart to the instant application, Oct. 14, 2015.
The State Intellectual Property Office of the People's Republic of China, Notice on Grant of Patent Rights for Invention, Application/Patent No. 201180071340.8, which is a CN counterpart application of the instant application, Jan. 4, 2016, a translation filed herewith.
Translation of the State Intellectual Property Office of the People's Republic of China, Notice on Grant of Patent Rights for Invention, Application/Patent No. 201180071340.8, which is a CN counterpart application of the instant application, Jan. 4, 2016.
The Patent Office of the State Intellectual Property Office of the People's Republic of China, Patent Certificate for Invention, Patent No. ZL201180071340.8, which is a CN counterpart to the instant application, Apr. 20, 2016.
United States Patent and Trademark Office, Notice of Final Office Action, U.S. Appl. No. 14/119,294, which is a related US application to the instant application, Mar. 18, 2016.
Patent Office of the Cooperation Council for the Arab States of the Gulf, Examination Report, Application No. GC 2012-21397, which is a GCC counterpart of a related U.S. Appl. No. 14/119,294 of the instant application, Apr. 11, 2016.

* cited by examiner

CHANGING THE STATE OF A SWITCH THROUGH THE APPLICATION OF POWER

CROSS-REFERENCE TO RELATED APPLICATIONS

This application is a United States national phase application claiming priority to International Application No. PCT/US2011/055729, entitled "Changing the State of a Switch Through the Application of Power," filed on Oct. 11, 2011; and International Application No. PCT/US2011/038900, entitled "Changing the State of a Switch Through the Application of Power," filed on Jun. 2, 2011.

RELATED APPLICATIONS

This application claims priority from International Patent Application No. PCT/US2011/038900, filed on Jun. 17, 2011.

BACKGROUND

An oil well typically goes through a "completion" process after it is drilled. Casing is installed in the well bore and cement is poured around the casing. This process stabilizes the well bore and keeps it from collapsing. Part of the completion process involves perforating the casing and cement so that fluids in the formations can flow through the cement and casing and be brought to the surface. The perforation process is often accomplished with shaped explosive charges. These perforation charges are often fired by applying electrical power to an initiator. Applying the power to the initiator in the downhole environment is a challenge.

DETAILED DESCRIPTION

The switches described herein can be used in a large number of applications. They will be described in the context of a downhole perforating system but that description is being provided as an example only and should not be understood to limit the application of the switch.

Figure 1:
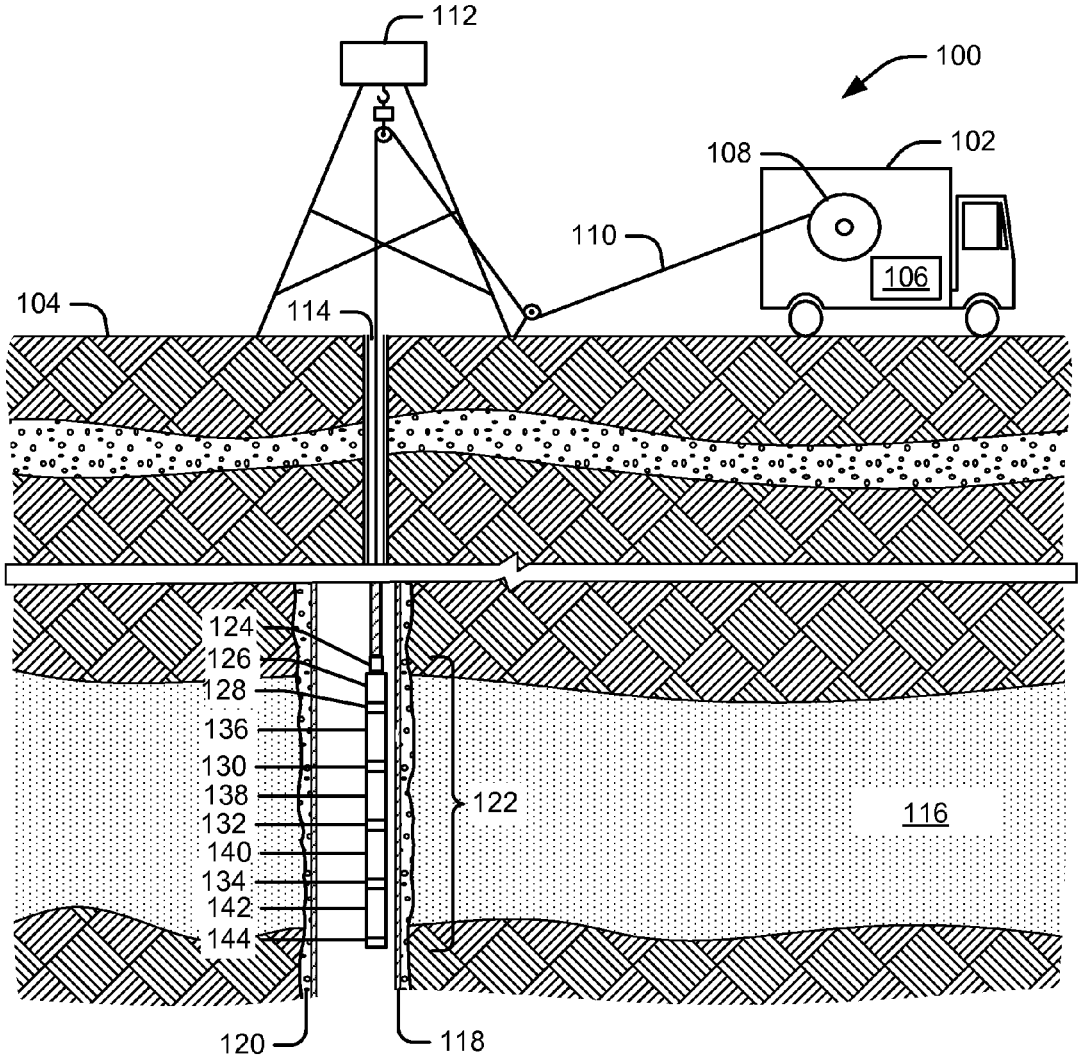
FIG. 1 illustrates a perforation system.

In one embodiment of a perforation system 100 at a drilling site, as depicted in FIG. 1, a logging truck or skid 102 on the earth's surface 104 houses a shooting panel 106 and a winch 108 from which a cable 110 extends through a derrick 112 into a well bore 114 drilled into a hydrocarbon-producing formation 116. In one embodiment, the derrick 112 is replaced by a truck with a crane (not shown). The well bore 114 is lined with casing 118 and cement 120. The cable 110 suspends a perforation apparatus 122 within the well bore 114.

Figure 2:
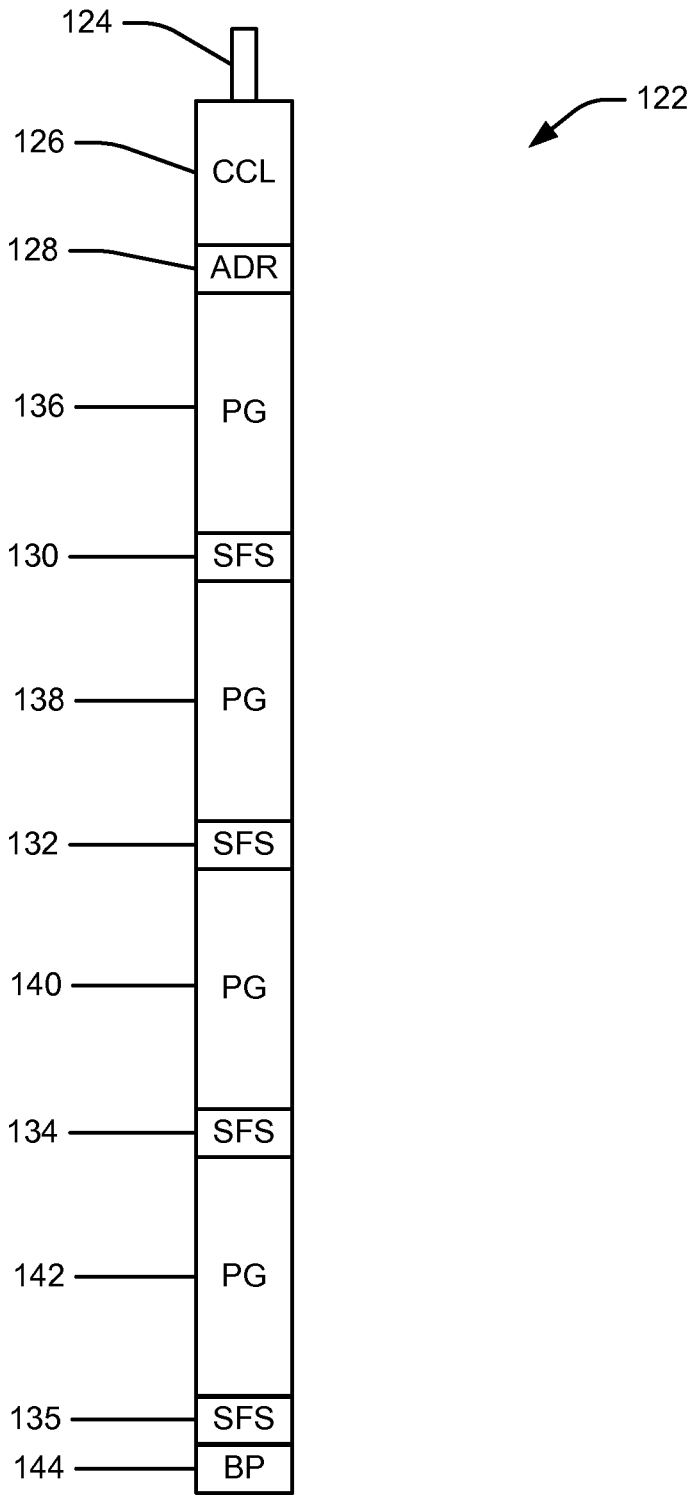
FIG. 2 illustrates a perforation apparatus.

In one embodiment shown in FIGS. 1 and 2, the perforation apparatus 122 includes a cable head/rope socket 124 to which the cable 110 is coupled. In one embodiment, an apparatus to facilitate fishing the perforation apparatus (not shown) is included above the cable head/rope socket 124. In one embodiment, the perforation apparatus 122 includes a casing collar locator ("CCL") 126, which facilitates the use of magnetic fields to locate the thicker metal in the casing collars (not shown). The information collected by the CCL can be used to locate the perforation apparatus 122 in the well bore 114. A gamma-perforator (not shown), which includes a CCL, may be included as a depth correlation device in the perforation apparatus 122.

In one embodiment, the perforation apparatus 122 includes an adapter ("ADR") 128 that provides an electrical and control interface between the shooting panel 106 on the surface and the rest of the equipment in the perforation apparatus 122.

In one embodiment, the perforation apparatus 122 includes a plurality of select fire subs ("SFS") 130, 132, 134, 135 and a plurality of perforation charge elements (or perforating gun or "PG") 136, 138, 140, and 142. In one embodiment, the number of select fire subs is one less than the number of perforation charge elements.

Figure 4:
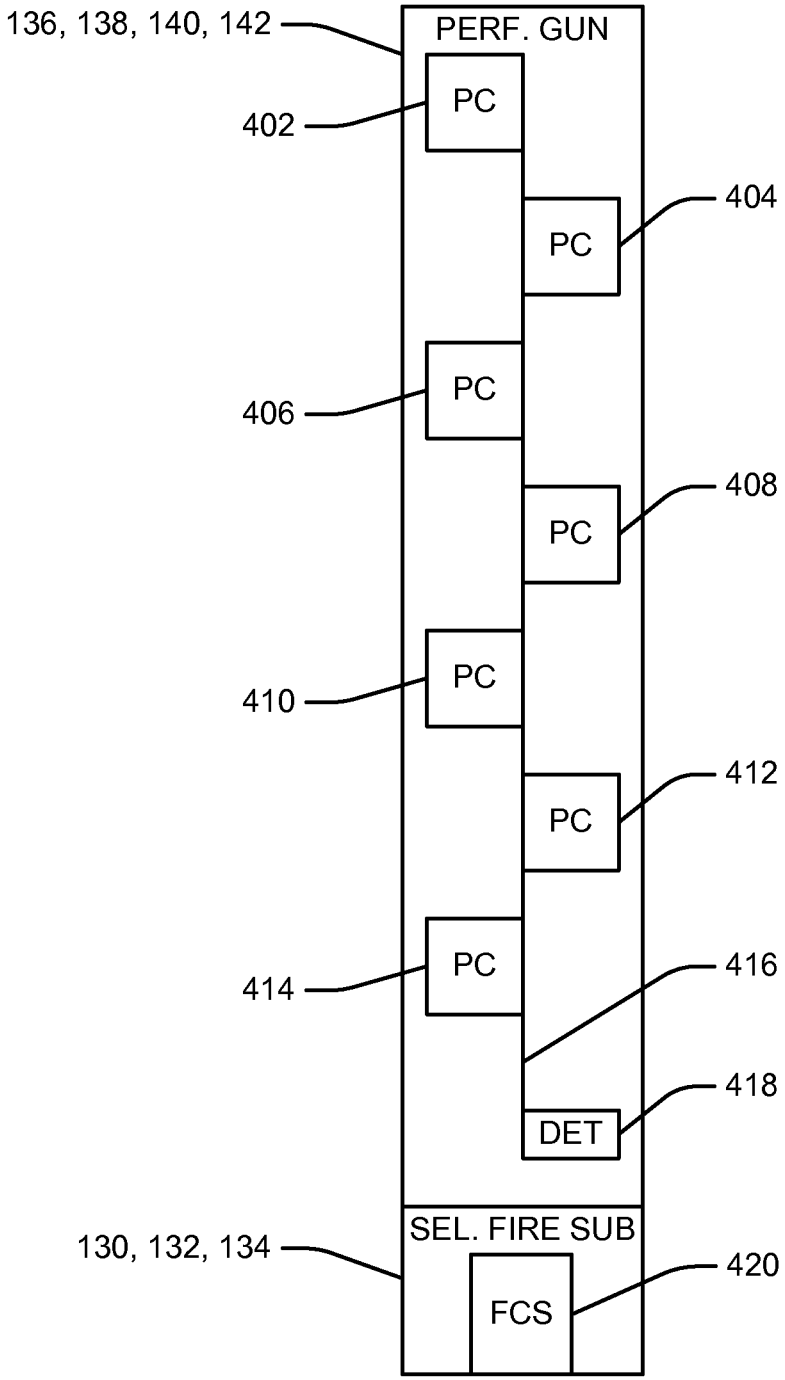
FIG. 4 is a block diagram of a perforation apparatus.

The perforation charge elements 136, 138, and 140 are described in more detail in the discussion of FIG. 4. It will be understood by persons of ordinary skill in the art that the number of select fire subs and perforation charge elements shown in FIGS. 1 and 2 is merely illustrative and is not a limitation. Any number of select fire subs and sets of perforation charge elements can be included in the perforation apparatus 122.

Figure 3:
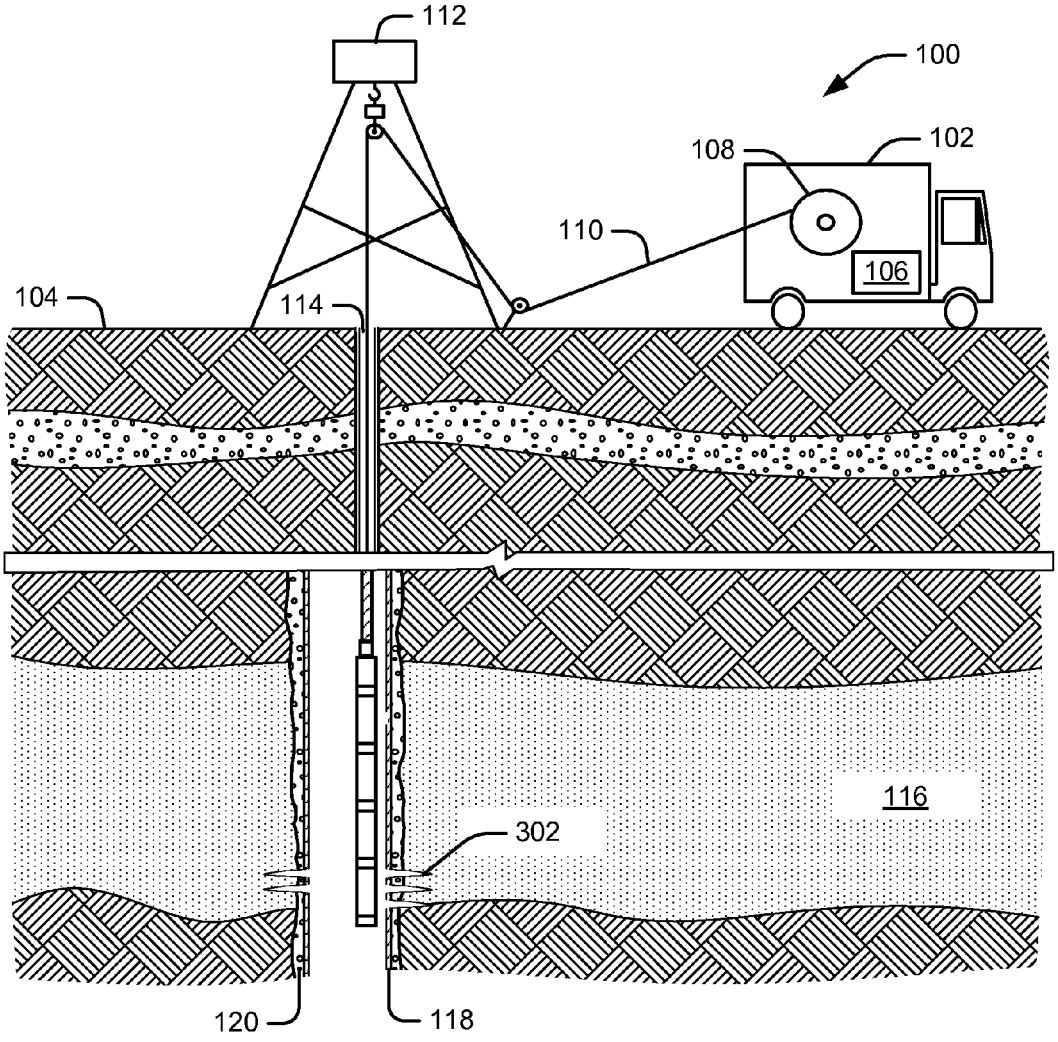
FIG. 3 illustrates the perforation system after one of the perforation charges has been fired.

In one embodiment, the perforation apparatus 122 includes a bull plug ("BP") 144 that facilitates the downward motion of the perforation apparatus 122 in the well bore 114 and provides a pressure barrier for protection of internal components of the perforation apparatus 122. In one embodiment, the perforation apparatus 122 includes magnetic decentralizers (not shown) that are magnetically drawn to the casing causing the perforation apparatus 122 to draw close to the casing as shown in FIG. 1. In one embodiment, a setting tool (not shown) is included to deploy and set a bridge or frac plug in the borehole FIG. 3 shows the result of the explosion of the lowest perforation charge element. Passages 302 (only one is labeled) have been created from the formation 116 through the concrete 120 and the casing 118. As a result, fluids can flow out of the formation 116 to the surface 104. Further, stimulation fluids may be pumped out of the casing 118 and into the formation 116 to serve various purposes in producing fluids from the formation 116.

One embodiment of a perforation charge element 136, 138, 140, 142, illustrated in FIG. 4, includes 6 perforating charges 402, 404, 406, 408, 410, 412, and 414. It will be understood that by a person of ordinary skill in the art that each perforation charge element 136, 138, 140, 142 can include any number of perforating charges.

In one embodiment, the perforating charges are linked together by a detonating cord 416 which is attached to a detonator 418. In one embodiment, when the detonator 418 is detonated, the detonating cord 416 links the explosive event to all the perforating charges 402, 404, 406, 408, 410, 412, 414, detonating them simultaneously. In one embodiment, a select fire sub 130, 132, 134, 135 containing a single fire clip switch ("FCS") 420 is attached to the lower portion of the perforating charge element 136, 138, 140, 142. In one embodiment, the select fire sub 130, 132, 134, 135 defines the polarity of the voltage required to detonate the detonator in the perforating charge element above the select fire sub. Thus in one embodiment, referring to FIG. 2, select fire sub 130 defines the polarity of perforating charge element 136, select fire sub 132 defines the polarity of perforating charge element 138, select fire sub 134 defines the polarity of perforating charge element 140, and select fire sub 135 defines the polarity of perforating charge element 142. In one embodiment not shown in FIG. 2, the bottom-most perforating charge element 142 is not coupled to a select fire sub (i.e., select fire sub 135 is not present) and thus can be detonated by a voltage of either polarity.

Figure 5:
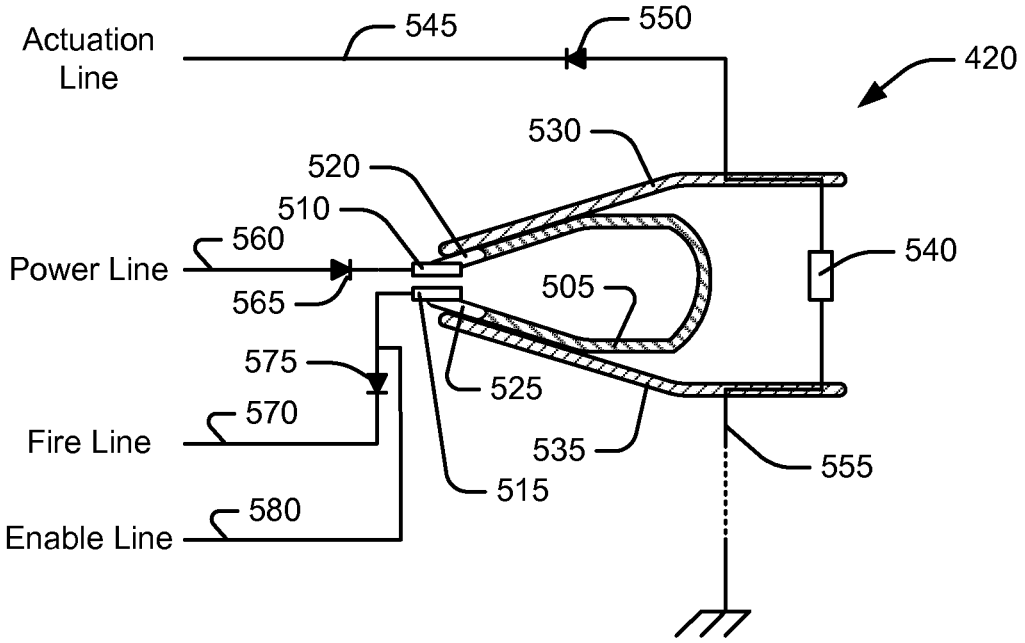
FIGS. 5-10, 12, 13, and 15-22 illustrate fire clip switches.

In one embodiment illustrated in FIG. 5, a fire clip switch 420 includes a state-change mechanism that is actuated by dissipating power across a collapsing element. In one embodiment, heat generated by the collapsing element triggers the state-change mechanism, causing the collapsing element to collapse or causing another element, such as a tie-wrap or an eutectic substance, to collapse or change physical state and to become significantly weak in a structural sense.

In one embodiment, the switch includes a C-shaped spring 505. In one embodiment, the spring 505 is mechanically coupled to a first contact 510 and a second contact 515. In one embodiment, portions of the spring, 520 and 525, adjacent to the first contact 510 and the second contact 515 are non-conductive to electricity. In one embodiment, the spring 505 is made of an elastic material such as steel. In one embodiment, in its non-deformed shape, the spring 505 closes more than is shown in FIG. 5 such that the first contact 510 and second contact 515 come into contact with each other and form a good electrical connection.

In one embodiment, the fire clip switch 420 includes two handles, or tension elements, 530 and 535. In one embodiment, the handles 530 and 535 are made of a material that is non-conductive material to electricity, such as plastic. In one embodiment, the handles 530 and 535 are mechanically coupled to the spring 505. In one embodiment, the handles 530, 535 are mechanically coupled to and held in the position shown in FIG. 5 by a collapsing element 540. That is, in one embodiment, the handles 530 and 535 are urged toward each other to the position shown in FIG. 5 and then the collapsing element 540 is mechanically affixed to the handles 530, 535 to hold them in place, which in turn deforms the spring 505 as shown in FIG. 5. In one embodiment, the spring 505 tends to urge the handles 530 and 535 away from each other such that when the fire clip switch 420 is in the state shown in FIG. 5, the collapsing element 540 is under mechanical stress. In one embodiment (not shown), the spring is a leaf spring fixed at a proximal end to a post. In one embodiment, the leaf spring is held in tension by a collapsing element, similar to collapsing element 540, so that its distal end is in electrical contact with a normally-closed contact. In one embodiment, when the collapsing element collapses structurally the distal end of the spring breaks electrical contact with the normally-closed contact and makes an electrical connection with a normally-open contact.

In one embodiment, the collapsing element 540 is coupled to an "actuation" line 545 through a diode 550 and to a ground line 555.

In one embodiment, the first contact 510 is coupled to a "power" line 560 through a diode 565. In one embodiment, contact 515 is coupled to a "fire" line 570 through a diode 575. In one embodiment, diode 575 is optional but is recommended for the safety of the fire clip switch 420.

Figure 11:
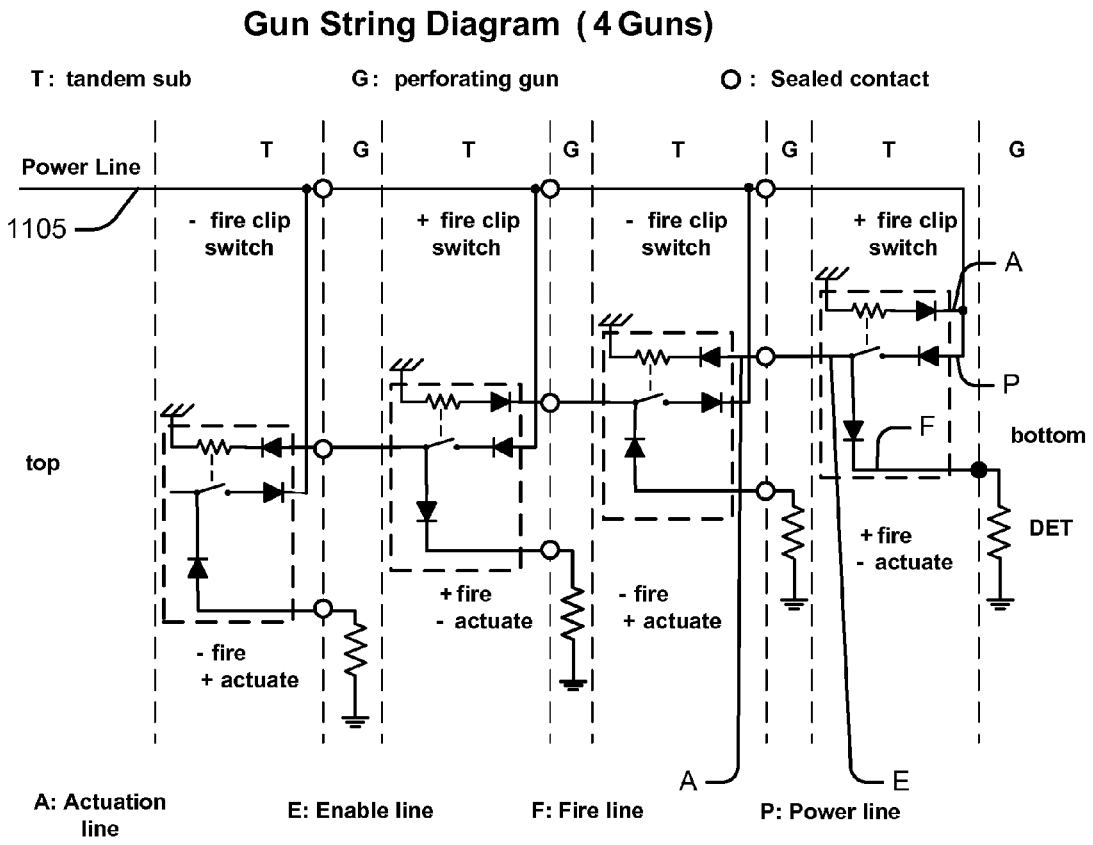
FIGS. 11 and 23 illustrate systems that include fire clip switches.

In one embodiment, an "enable" line 580 is coupled to the "actuation" line 545 of a higher switch in the perforation apparatus 122 so that fire clip switches can be chained together, as shown in FIG. 11 and discussed below. In one embodiment, the "power" line 560 and the "actuate" line 545 of the bottommost switch are coupled to each other and to a Power Line 1105 from the shooting panel 106 as shown in FIG. 11 and discussed below.

Figure 6:
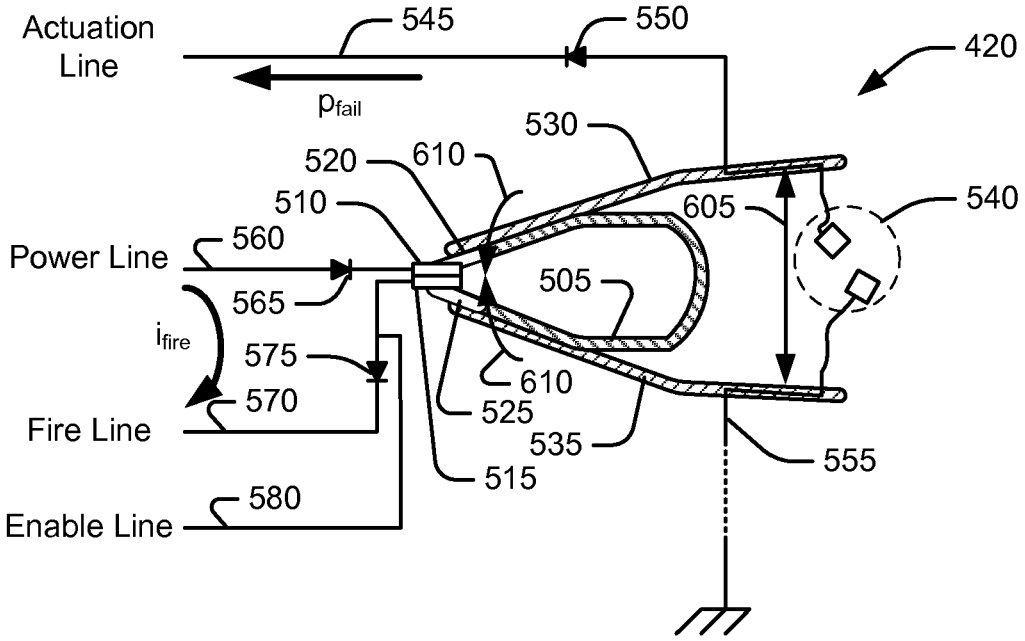

In one embodiment, as shown in FIG. 6, a power $p_{fail}$, shown by an arrow that reflects the polarity of the power $p_{fail}$, is applied to the collapsing element 540 where power $p_{fail}$ is sufficient to cause collapsing element 540 to collapse structurally, as indicated by the two broken parts in the circle designated 540 in FIG. 6.

For example, in one embodiment, the collapsing element 540 is a resistor. In one embodiment, the collapsing element 540 is a 10 watt resistor that collapses structurally (e.g., explodes) if it is exposed to 50 watts of power. In that case, if the voltage across the resistor collapsing element 540 is 200 volts and the current flowing through the resistor collapsing element 540 is 250 milliamps, the resistor 540 is being exposed to 50 watts (200 volts×250 milliamps) and the resistor 540 will fail by, for example, exploding.

In one embodiment, the collapsing element 540 is an electrolytic capacitor that is destroyed by the application of power of a sufficient magnitude and a "wrong" polarity. In one embodiment, the application of power $p_{fail}$ destroys the electrolytic capacitor.

In one embodiment, the collapsing element 540 is an electromagnetic choke with a magnetic core that fails catastrophically upon the application of power $p_{fail}$.

Persons of ordinary skill would recognize that the collapsing element 540 could be made from other components, such as semiconductors, etc., or an arrangement thereof, that structurally collapse under the application of electrical power.

As mentioned above, when the fire clip switch 420 is in the state shown in FIG. 5, the collapsing element 540 is under stress and the spring 505 is urging the handles 530 and 535 apart. In one embodiment, when the collapsing element 540 fails, as shown in FIG. 6, the handles 530 and 535 move apart as indicated by the arrow 605 and the spring 505 moves as shown by the arrows 610. In one embodiment, the movement of the spring 505 causes the first contact 510 to come into contact with the second contact 515, closing a circuit between the power line 560 and the fire line 570 through diodes 565 and 575, which allows a current $i_{fire}$ to flow in the direction shown by the arrow in FIG. 6.

Figure 7:
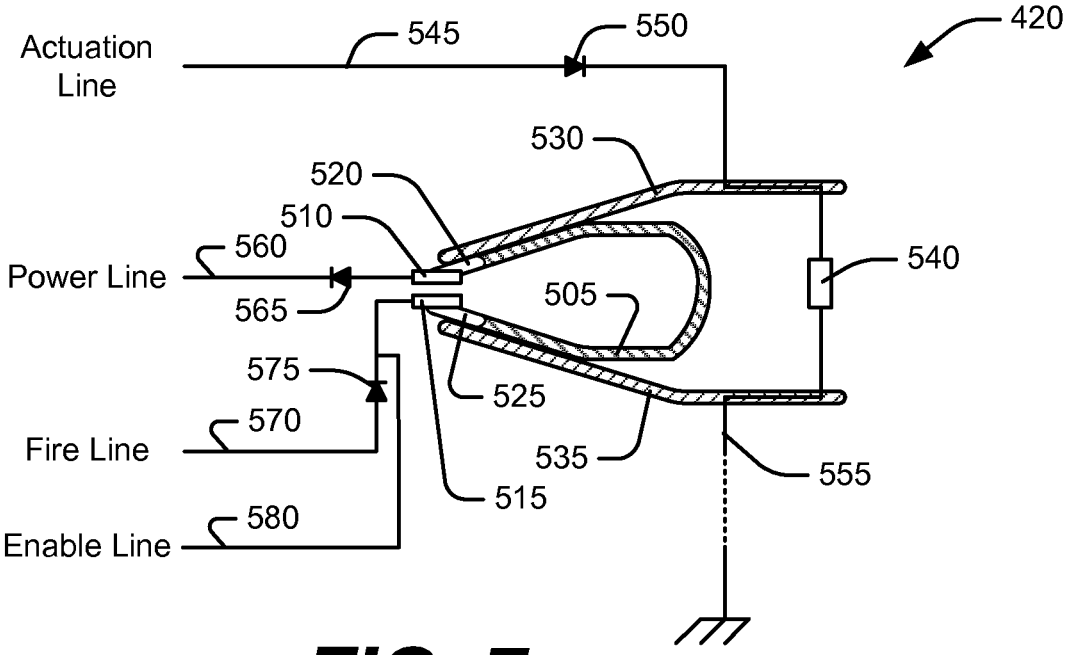
Figure 8:
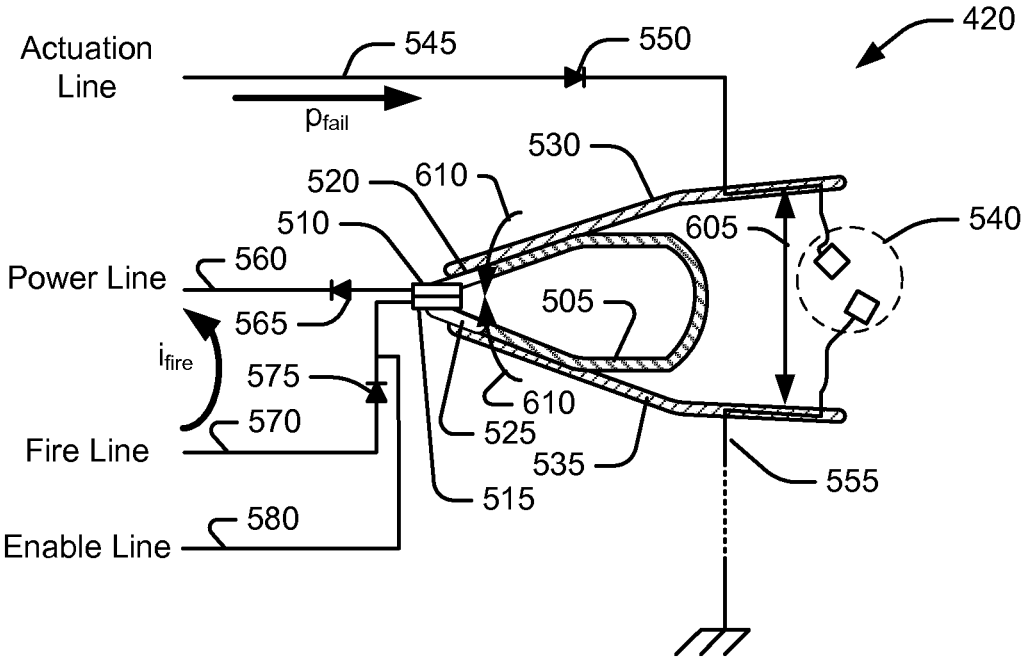

In one embodiment, shown in FIG. 7, the direction of current flow (or the polarity of the applied power) is reversed (as compared to the direction of current flow in FIG. 5) in both the actuation circuit, the circuit that includes the collapsing element 540, and the firing circuit, the circuit that includes the first contact 510 and the second contact 515. In one embodiment, the direction of current flow in the actuation circuit is reversed by reversing the polarity of diode 550 as compared to the polarity of diode 550 in FIG. 5. In one embodiment, the direction of current flow in the firing circuit is changed by changing the polarity of diodes 565 and 575 as compared to the polarity of diodes 565 and 575 in FIG. 5. Thus, in FIG. 5 the actuation circuit is activated by negative power and in FIG. 7, the actuation circuit is activated by positive power. In FIG. 5 the firing circuit is activated by positive power and in FIG. 7, the firing circuit is activated by negative power. In both FIG. 5 and FIG. 7, the power to activate the actuation circuit has the opposite polarity of the power to activate the firing circuit. FIG. 8, which is the same as FIG. 6 except for the polarity of $i_{fail}$ and $i_{fire}$, shows the fire clip switch 420 after the collapsing element 540 has failed.

Figure 9:
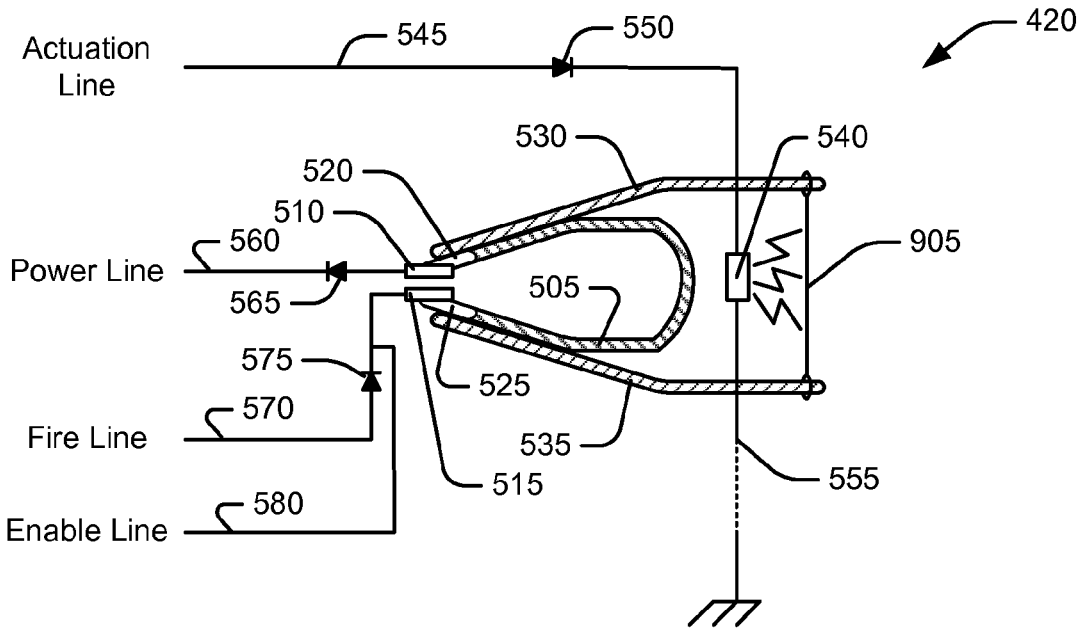

In one embodiment, illustrated in FIG. 9, the collapsing element 540, rather than failing itself, causes a restraining element 905 to fail. In one embodiment, the strain on the spring 505 is created by the restraining element 905 rather than the collapsing element 540. In one embodiment, while the collapsing element 540 is mechanically coupled to the handles 530 and 535, the mechanical coupling is not sufficiently strong to maintain the handles 530 and 535 in the positions shown in FIG. 9. Instead, the handles 530 and 535 are maintained in the positions shown by the restraining element 905.

In one embodiment, the restraining element 905 is an element that is predictably susceptible to structural failure when it exposed to heat. In one embodiment, the restraining element 905 is a tie wrap. In one embodiment, the restraining element is a rubber band. In one embodiment, the restraining element 905 905 is a eutectic substance, i.e., a mixture of two or more substances with a melting point lower than any of the substances in the mixture. In one embodiment, the eutectic substance is solder.

Figure 10:
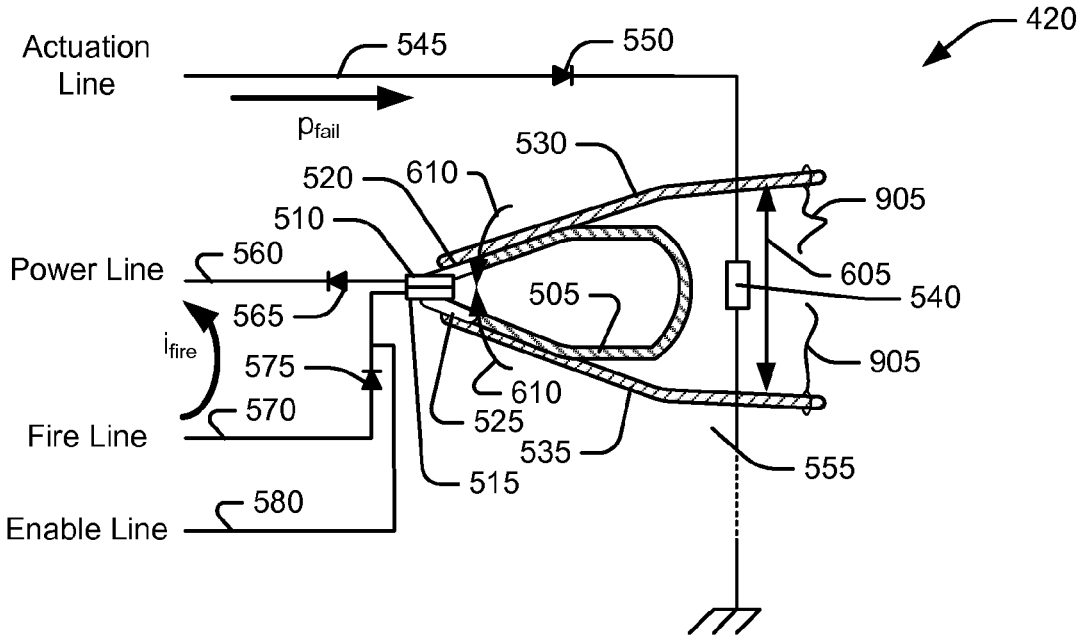

In one embodiment, the circuit in FIG. 9 operates in the same way as the circuit shown in FIG. 5 except that instead of the collapsing element 540 failing as in FIG. 5, heat from the collapsing element 540, indicated by the lightning bolt symbols adjacent the collapsing element 540 in FIG. 9, cause the restraining element 905 to melt or otherwise change state and fail or to weaken sufficiently to allow the spring to relax. The result, as shown in FIG. 10, is the same as in FIG. 6, except that the restraining element 905 has failed instead of the collapsing element 540. The contacts 510 and 515 have closed allowing the firing current $i_{fire}$ to flow through the firing circuit.

In one embodiment, illustrated in FIG. 11, a plurality of fire clip switches, such as those illustrated in FIGS. 5-10, is incorporated in a gun string. In the figure, the dashed lines separate tandem subs, denoted by the letter "T," and perforating guns, denoted by the letter "G." In one embodiment, the tandem subs hold the fire clip switches and interconnect the perforating guns. In one embodiment, the fire clip switches are installed alternately, i.e., a positive switch follows a negative switch and vice versa. In one embodiment, the bottommost fire clip switch is a positive fire clip switch, as shown in FIG. 11. In one embodiment, the bottommost fire clip switch is a negative fire clip switch.

The open circles in FIG. 11 represent sealed contacts between the tandem subs and the perforating guns. In one embodiment, a setting tool (not shown) is included and similar sealed contacts are provided between the setting tool and the bottommost perforating gun. In one embodiment, each of the dashed boxes represents a positive fire clip switch, such as that shown in FIGS. 5, 6, 9, and 10, or a negative fire clip switch, such as that shown in FIGS. 7 and 8. The resistors in the gun portions of FIG. 11 represent detonators that, in one embodiment, fire when sufficient current flows through them. The tandem subs and perforating guns are arranged in a string with the bottom of the string represented at the far right of FIG. 11 and the top of the string represented at the far left of FIG. 11.

In one embodiment, a "power" line 1105 crosses through all the tandems and guns except for the bottom one. In one embodiment, the "actuation" line of the bottommost fire clip switch is coupled to the "power" line, as shown in FIG. 11. In one embodiment, the "enable" line of the bottommost fire clip switch is coupled to the "actuation" line of the fire clip switch of immediately above it in the string, as shown in FIG. 11. In one embodiment, the "actuation" line of all but the bottommost fire clip switch is connected to the "enable" line of the fire clip switch below it in the string, as shown in FIG. 11.

In one embodiment, at installation time all switches are in an open state where the contacts do not touch each other, such as that shown in FIGS. 5, 7, and 9. In one embodiment, the wires going from a tandem sub to a gun are hydraulically sealed, as indicated by the open circles on FIG. 11, to prevent fluid from entering a tandem sub after the gun immediately below is fired and borehole fluids fill the gun body.

In one embodiment, the bottommost switch is a positive fire switch, such as that shown in FIGS. 5, 6, 9, and 10. In one embodiment, all switches in the string are stressed, keeping the electrical contacts separated (i.e., the contacts associated with each switch are not in contact with each other). The stress is held by the collapsing element 540 or by the restraining element 905. In one embodiment, when sufficiently high negative voltage is applied to the power line 1105 in FIG. 11, which corresponds to the actuation line 545 in FIGS. 5-10, a large current flows through diode 550 and through the collapsing element 540. In one embodiment, the current causes the collapsing element 540 or the restraining element 905 to fail, assisted by the force exerted by the spring 505, as discussed above. In one embodiment, the force of the spring is also used also to enhance the quality of the grounding connection to the gun chassis. In one embodiment, diodes 565 and 575 provide a double barrier against accidentally firing the detonator while the switch is being actuated. In one embodiment, as the collapsing element 540 or the restraining element 905 fails, the spring relaxes and the contacts 510 and 515 come together. This creates a path for positive current to flow from the power line through diodes 565 and 575 through the detonator to the gun chassis, which, in one embodiment, is the circuit ground.

In one embodiment, when the detonator is fired using positive voltage, the switch installed in the gun above, which uses a switch of opposed polarity, is actuated and its contacts are shorted (causing its associated switch to be closed). In one embodiment, the detonator in that gun (or in a setting tool if included) can now be fired using negative voltage.

In one embodiment, all subsequent guns are fired in accordance with the procedure presented above, until the last gun is fired. In one embodiment, the gun string is engineered so that the collapsing element 540 or the restraining element 905 collapses before the borehole fluid invades the fired gun (and shorts the actuation line).

In one embodiment, the system shown in FIG. 11 presents no significant ohmic losses, which allows it to be used with gun strings involving a very large number of perforating guns. In one embodiment, this also means that the surface system, i.e., the firing panel 106, sees practically the same impedance across the shooting connection.

Figure 12:
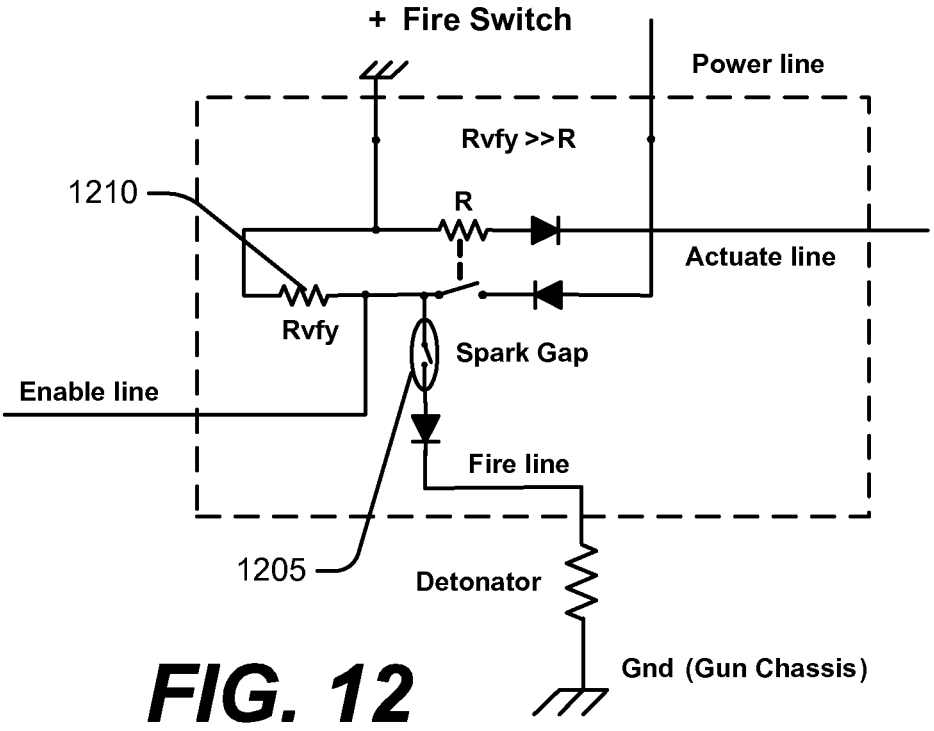

One embodiment, illustrated in FIG. 12, includes a voltage barrier, such as spark gap 1205, to give better assurance that the collapsing element 540 or the restraining element 905 collapses before the explosion takes place, if, for example, the shooting voltage is ramped up instead of being applied in a single step/"voltage dump". In one embodiment in which the collapsing element is a resistor installed in series with another resistor (such as the resistance represented by wireline conductors) connecting to a power supply, the value of the resistor is chosen to be low enough that the voltage across it under maximum power conditions is always lower than the voltage barrier provided by a diode or set of diodes installed in series with the detonator.

Figure 13:
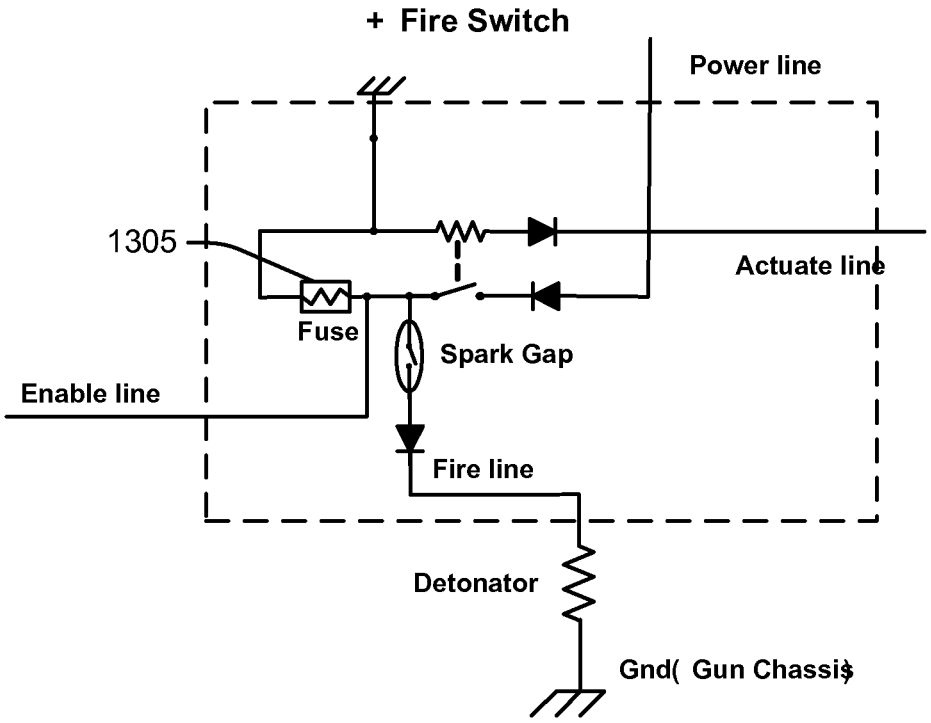

One embodiment, illustrated in FIGS. 12 and 13, includes a verification device, such as a resistor (Rvfy) 1210, having an impedance much greater than the collapsing element 540, or a fuse 1305 that is used to verify through the power line (using a resistance meter) that the switch was successfully actuated. The change in line current that occurs when the fuse 1305 blows serves to indicate the actuation of the switch.

In one embodiment, the wires going from the tandem to the gun are not sealed with o-rings. In one embodiment, the seal is provided by an epoxy or another type of hydraulic sealing and non-conductive compounds that provides a barrier that prevents the fluids invading from reaching the upper gun and from coming in contact with the switch and shorting its contacts.

Figure 14:
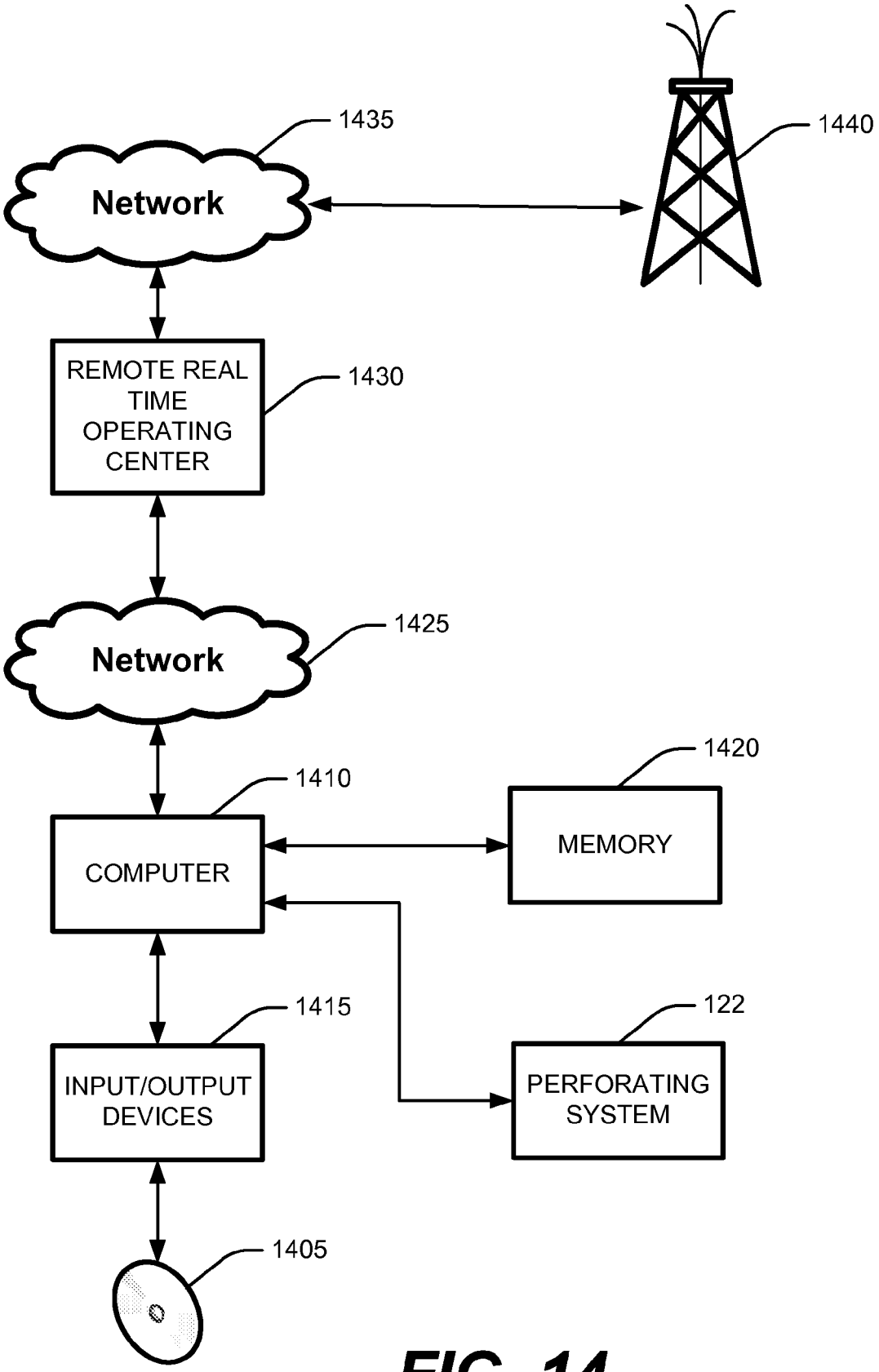
FIG. 14 illustrates a system that includes a perforation system.

In one embodiment, the perforating system 122 is controlled by software in the form of a computer program on a computer readable media 1405, such as a CD or DVD, as shown in FIG. 14. In one embodiment, a computer 1410, which may be the same as or included in the firing panel 106 or may be located with the perforation apparatus 122, reads the computer program from the computer readable media 1405 through an input/output device 1415 and stores it in a memory 1420 where it is prepared for execution through compiling and linking, if necessary, and then executed. In one embodiment, the system accepts inputs through an input/output device 1415, such as a keyboard, and provides outputs through an input/output device 1415, such as a monitor or printer. In one embodiment, the system stores the results of calculations in memory 1420 or modifies such calculations that already exist in memory 1420.

In one embodiment, the results of calculations that reside in memory 1420 are made available through a network 1425 to a remote real time operating center 1430. In one embodiment, the remote real time operating center 1430 makes the results of calculations available through a network 1435 to help in the planning of oil wells 1440 or in the drilling of oil wells 1440.

In one embodiment, it is useful for a fire clip switch to have more than one contact. For example, if a perforating gun (i.e., one of the regions labeled with "G" in FIG. 11) is flooded with a conductive fluid as the result of the firing of a detonator, the conductive fluid may create a short circuit between the Power line and the housing of the gun string. That short may prevent the unfired guns from firing. For example, suppose that firing of the bottommost gun in FIG. 11 causes the perforating gun ("G") just above it to flood with a conductive fluid shorting the Power line to ground. Subsequent attempts to fire the next-higher gun would fail because of the shorted Power line.

Figure 23:
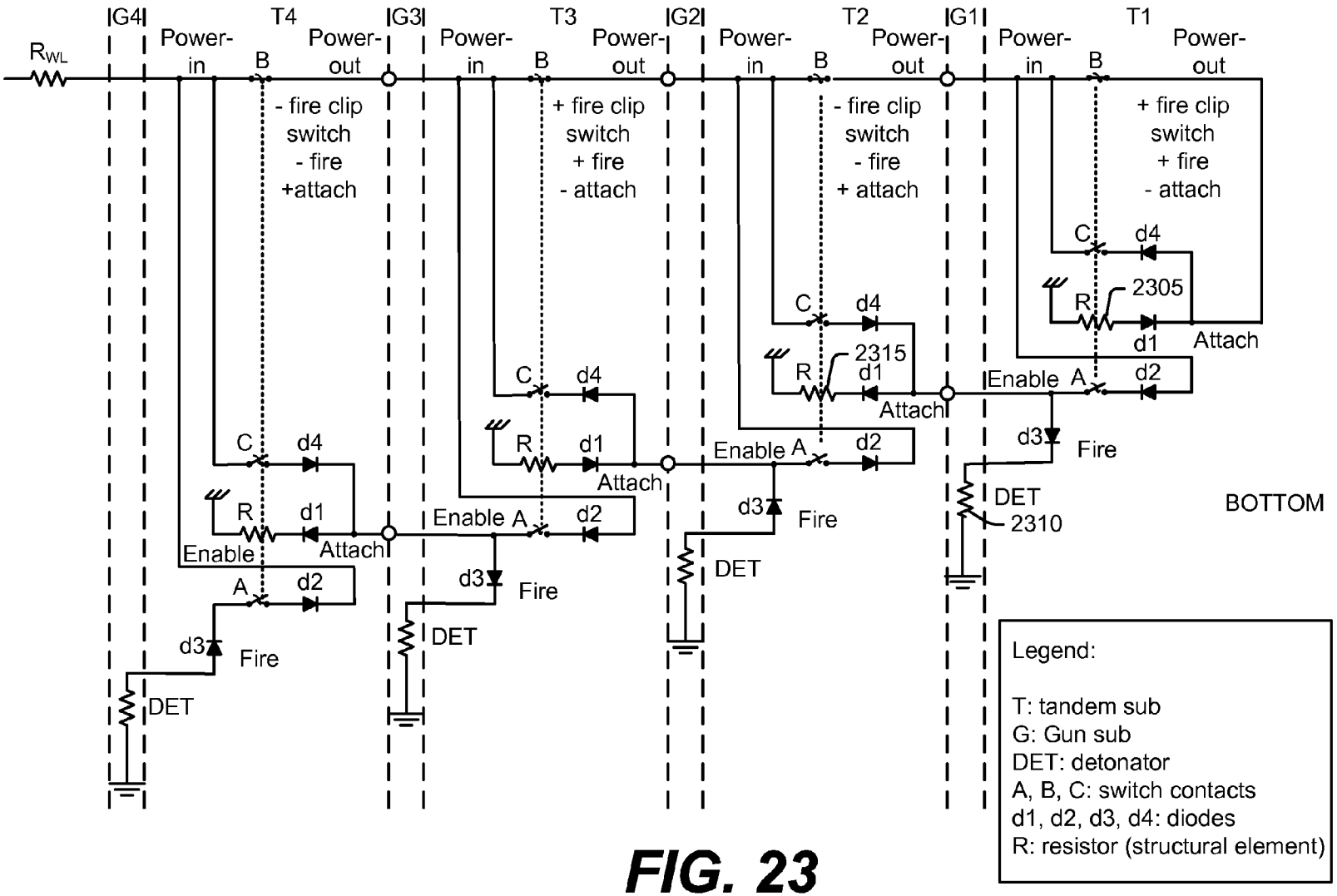

In one embodiment, the fire clip switch is provided with multiple contacts. In one embodiment, at least some of the multiple contacts of the fire clip switch are used to isolate the perforating gun, as shown in FIG. 23, discussed below, so that flooding of those perforating guns does not disable other perforating guns in the gun string from firing.

Figure 15:
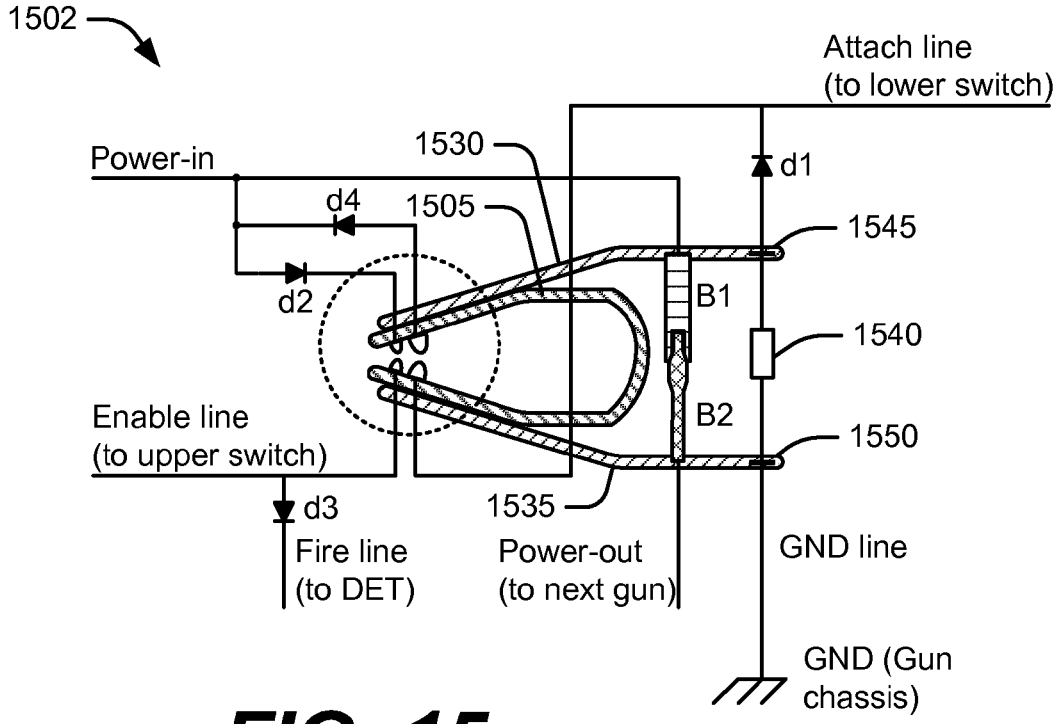

In one embodiment, illustrated in FIG. 15, a fire clip switch 1502, which is otherwise similar in construction and operation to the fire clip switch 420 illustrated in FIGS. 5-10, includes three sets of switch contacts, two sets of normally-open contacts and one set of normally-closed contacts. It will be understood that the number of normally-open contacts and the number of normally-closed contacts discussed herein is merely illustrative and that any number of either variety of contacts can be included. The fire clip switch 1502 includes a spring 1505 that, in one embodiment is made of non-conductive material. The fire clip switch 1502 further includes two handles 1530 and 1535 that are coupled to the spring 1505 as shown in FIG. 15. In one embodiment, the two handles 1530 and 1535 are made of non-conductive material. In one embodiment, the fire clip switch includes a collapsing element 1540 that is similar to the collapsing element 540 described above with respect to FIGS. 5-10. In one embodiment, the spring 1505, handles 1530 and 1535, and the collapsing element 1540 operate similarly to the similar elements described above with respect to FIGS. 5-10.

In one embodiment, the fire clip switch 1502 includes two normally-closed contacts B1 and B2, that are connected to each other when the fire clip switch 1502 is in the state shown in FIG. 15 (i.e., before the collapsing element 1540 has collapsed). In one embodiment, the normally-closed contacts B1 and B2 are pressure fit together so that they maintain mechanical and electrical contact when the fire clip switch 1502 is in the state shown in FIG. 15 but can be separated by the application of force of an appropriate magnitude in the opposite direction to the two contacts B1 and B2. In one embodiment, the spring 1505 applies a force of an appropriate magnitude when the collapsing element 1540 collapses and allows the spring 1505 to collapse back to its non-deformed state.

In one embodiment, shown in FIG. 15, contact B1 is rigidly mounted to handle 1530 and contact B2 is rigidly mounted to handle 1535. In one embodiment, one or both of the contacts B1 and B2 is flexibly mounted to its respective handle 1530 and 1535. In one embodiment, one or both of the contacts B1 and B2 is attached to its respective handle 1530 and 1535 by a tether or wire (not shown).

In one embodiment, the collapsing element 1540 is mechanically coupled to the handles 1530 and 1535 by anchors 1545 and 1550 that are embedded in handles 1530 and 1535, respectively. In one embodiment, the collapsing element 1540 is mechanically coupled to the handles 1530 and 1535 by, for example, wrapping leads of the collapsing element 1540, which in one embodiment is, for example, a low wattage resistor, a diode, or a length of NiCh (nickel chrome) wire, around handles 1530 and 1535, respectively.

Figure 16:
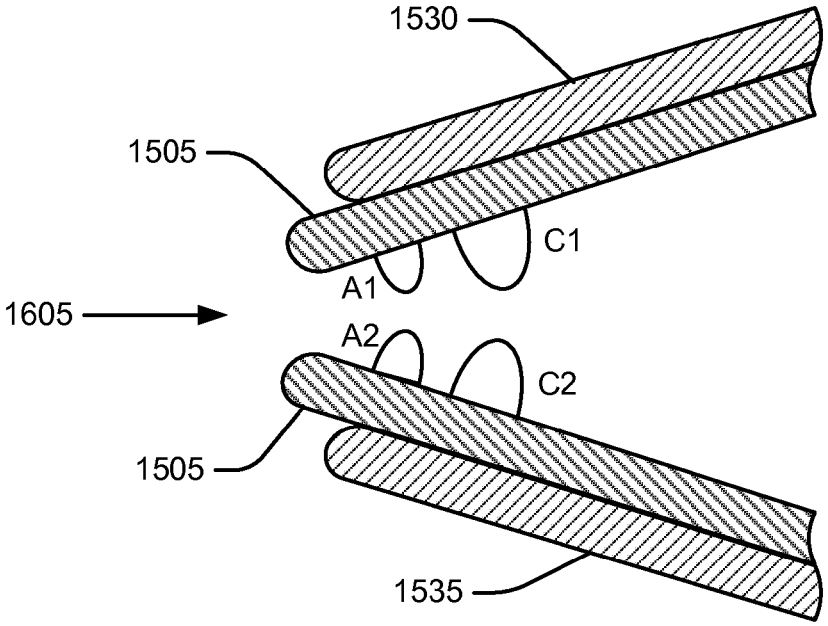

The normally-open contacts are illustrated in FIG. 16, which is a more detailed version of the area enclosed by the dashed circle in FIG. 15. As can be seen in FIG. 16, a first pair of normally-open contacts A1 and A2 is coupled to the spring 1505 at a place near the opening 1605 in the spring 1505. Contact A1 is electrically isolated from contact A2 when the fire clip switch 1502 is in the condition shown in FIG. 15. A second pair of normally-open contacts C1 and C2 is coupled to the spring 1505 such that the contacts A1 and A2 are closer to the opening 1605 than the contacts C1 and C2. Contact C1 is electrically isolated from contact C2 when the fire clip switch 1502 is in the condition shown in FIG. 15.

In one embodiment, as discussed above, the spring 1505 is completely non-conductive. In one embodiment, the spring 1505 is non-conductive in the area where the contacts A1, A2, C1, and C2 are coupled. In one embodiment, the spring 1505 is conductive and contacts A1, A2, C1, and C2 are coupled to the spring 1505 using a non-conductive material or using a separator (not shown), such as a rubber or plastic gasket or washer, to prevent the contacts A1, A2, C1, and C2 from being electrically connected to the spring 1505.

Returning to FIG. 15, in one embodiment, a "Power-in" line is coupled to contact B1, the anode of diode d2, and the cathode of diode d4. In one embodiment, the cathode of diode d2 is coupled to contact A1. In one embodiment, the anode of diode d4 is coupled to contact C1.

In one embodiment, an "Enable" line is coupled to the anode of diode d3 and to contact A2. Further, in one embodiment, as will be seen in the discussion of FIG. 23, the Enable line of one fire clip switch can be coupled to an "Attach" line (discussed below) of the next-higher fire clip switch in a gun string.

In one embodiment, a "Fire" line is coupled to the cathode of diode d3. In one embodiment, as will be seen in the discussion of FIG. 23, the Fire line is coupled to a detonator.

In one embodiment, a "Power-out" line is coupled to contact B2. Further, in one embodiment, as will be seen in the discussion of FIG. 23, the Power-out line can be coupled to the Power-in line of the next-lower gun.

In one embodiment, a "GND" line is coupled to one side of the collapsing element 1540. Further, in one embodiment, as will be seen in the discussion of FIG. 23, the GND line is coupled to the gun chassis.

In one embodiment, an "Attach" line is coupled to the cathode of diode d1 and to contact C2. In one embodiment, the anode of diode d1 is coupled to the side of the collapsing element 1540 opposite the connection to the GND line. Further, in one embodiment, as will be seen in the discussion of FIG. 23, the Attach line is coupled to the Enable line of the next-lower fire clip switch in the gun string.

Figure 17:
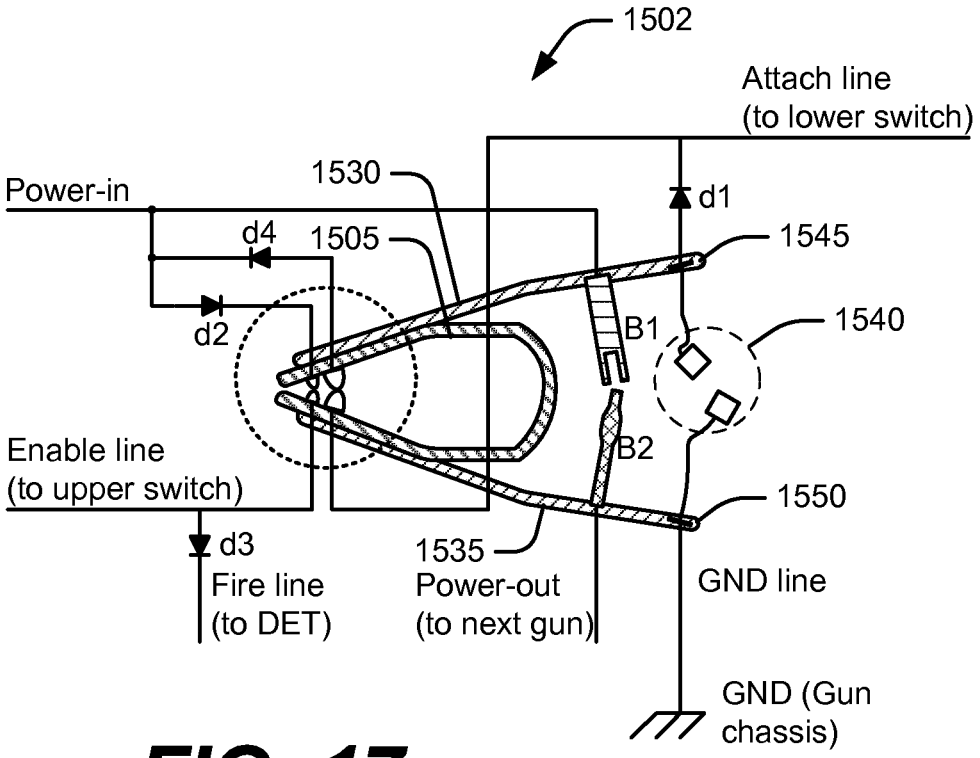
Figure 18:
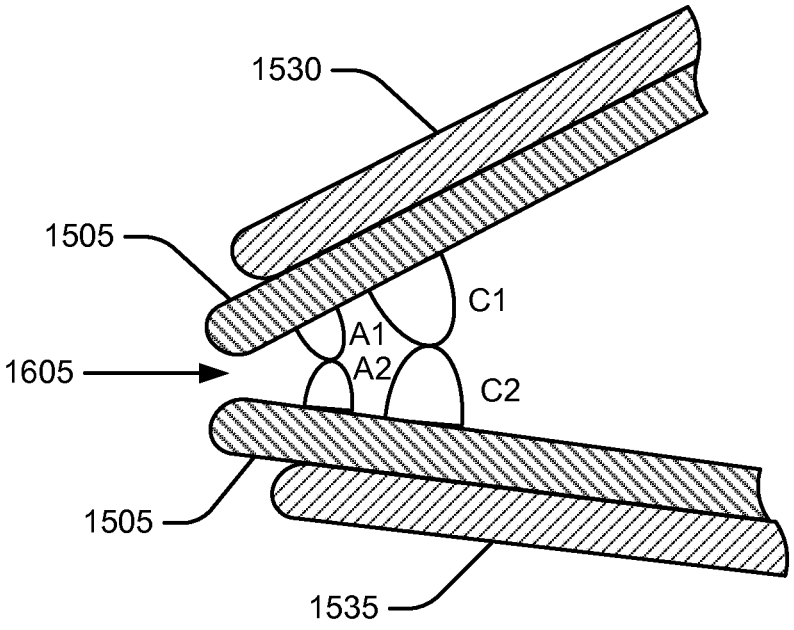

FIGS. 17 and 18 illustrate the fire clip switch 1502 after the collapsing element (indicated by the two broken pieces within the coarsely dashed circle labeled 1540) has collapsed. The collapse of the collapsing element 1540 allows the spring to relax and narrow opening 1605 to a state in which the contact A1 is mechanically and electrically connected to contact A2 and contact C1 is mechanically and electrically connected to contact C2, as shown in FIG. 18. The relaxation of the spring 1505 causes the handle 1545 to move away from the handle 1550, which causes contact B1 to disconnect from contact B2. Thus, in one embodiment, the collapse of the collapsing element 1540 closes contact A1 to contact A2 and contact C1 to contact C2 and disconnects contact B1 from contact B2.

Generally, in one embodiment, the spring 1505 has a first spring state, i.e., the state shown in FIG. 15, in which it is being held in tension by a restraining element, such as the collapsing element 1540. Alternatively, the restraining element is similar in construction and operation to the restraining element 905 shown in FIGS. 9 and 10. In one embodiment, the spring 1505 has a second spring state, i.e., the state shown in FIG. 17, in which it is not being held in tension because the restraining element, such as the collapsing element 1540, has structurally failed. In one embodiment, the collapsing element 1540 is situated or positioned such that, when sufficient power is applied to the collapsing element 1540, heat from the collapsing element 1540 will cause the restraining element, e.g. the collapsing element 1540 itself or the restraining element 905, to fail.

In one embodiment, a first contact, e.g., A1, C1, or B1, is coupled to the spring 1505. In one embodiment, contact B1 is indirectly coupled to the spring 1505 through the handle 1530. In one embodiment, a second contact, e.g., A2, C2, or B2 is coupled to the spring 1505. In one embodiment, contact B2 is indirectly coupled to the spring through the handle 1535.

In one embodiment, the first contact and the second contact have a "first 1-2 electrical connection state" when the spring 1505 is in the first spring state. For example, if the first contact is A1 or C1 and the second contact is A2 or C2, the first spring state has the first contact electrically isolated, separate, or disconnected from the second contact. If the first contact is B1 and the second contact is B2, the first spring state has the first contact electrically connected to the second contact so that electrical current can flow from the first contact to the second contact.

In one embodiment, the first contact and the second contact have a "second 1-2 electrical connection state" when the spring 1505 is in the second spring state. For example, if the first contact is A1 or C1 and the second contact is A2 or C2, the second spring state has the first contact electrically connected to the second contact. If the first contact is B1 and the second contact is B2, the second spring state has the first contact electrically isolated, separate, or disconnected from the second contact so that electrical current can flow from the first contact to the second contact.

In one embodiment, a third contact, e.g., A1, C1, or B1, is coupled to the spring 1505. In one embodiment, contact B1 is indirectly coupled to the spring 1505 through the handle 1530. In one embodiment, a fourth contact, e.g., A2, C2, or B2, is coupled to the spring 1505. In one embodiment, contact B2 is indirectly coupled to the spring through handle 1535.

In one embodiment, the third contact and the fourth contact have a "first 3-4 electrical connection state" when the spring is in the first spring state. For example, if the third contact is A1 or C1 and the fourth contact is A2 or C2, the first spring state has the third contact electrically isolated, separate, or disconnected from the fourth contact so that no current can flow across the boundary between the third contact and the fourth contact. If the third contact is B1 and the fourth contact is B2, the first spring state has the third contact electrically connected to the fourth contact so that electrical current can flow from the third contact to the fourth contact.

In one embodiment, the third contact and the fourth contact have a "second 3-4 electrical connection state" when the spring 1505 is in the second spring state. For example, if the third contact is A1 or C1 and the fourth contact is A2 or C2, the second spring state has the third contact electrically connected to the fourth contact so that electrical current can flow from the third contact to the fourth contact. If the third contact is B1 and the fourth contact is B2, the second spring state has the third contact electrically isolated, separate, or disconnected from the fourth contact so that no current can flow across the boundary between the third contact and the fourth contact.

Figure 19:
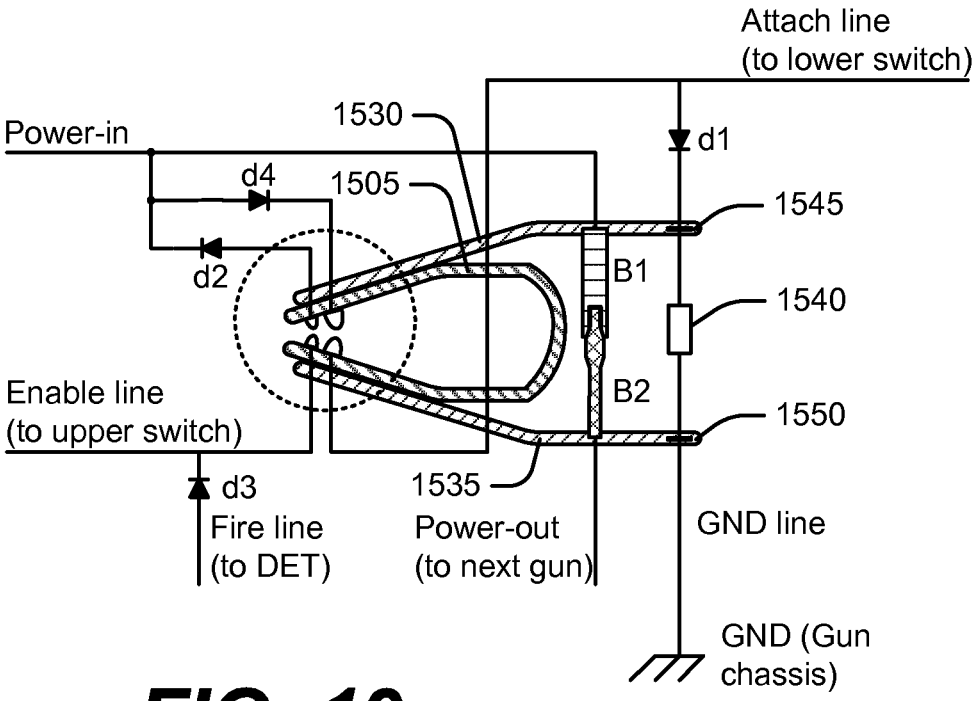
Figure 20:
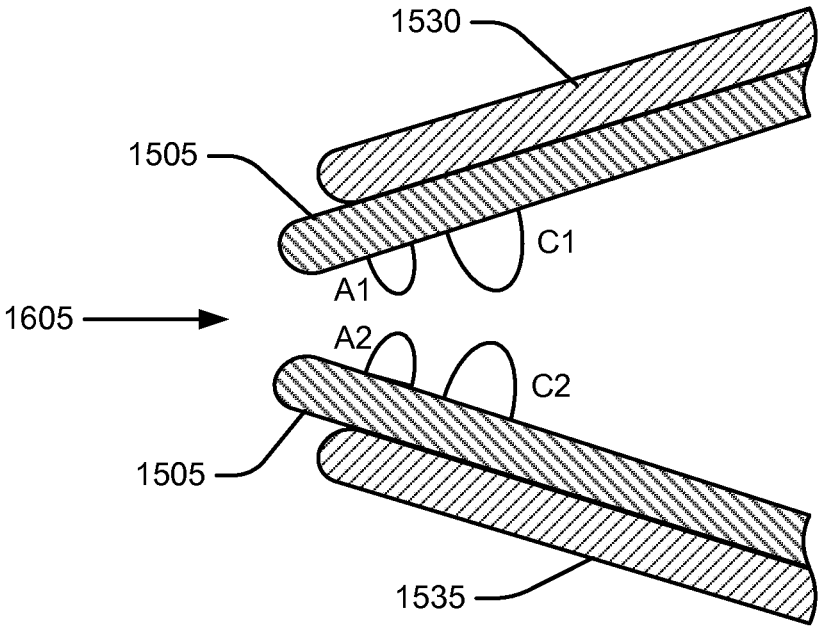

FIGS. 19 and 20 are identical to FIGS. 15 and 16 except that the polarity of the diodes is reversed. FIG. 15 shows a positive switch. FIG. 19 shows a negative switch.

Figure 21:
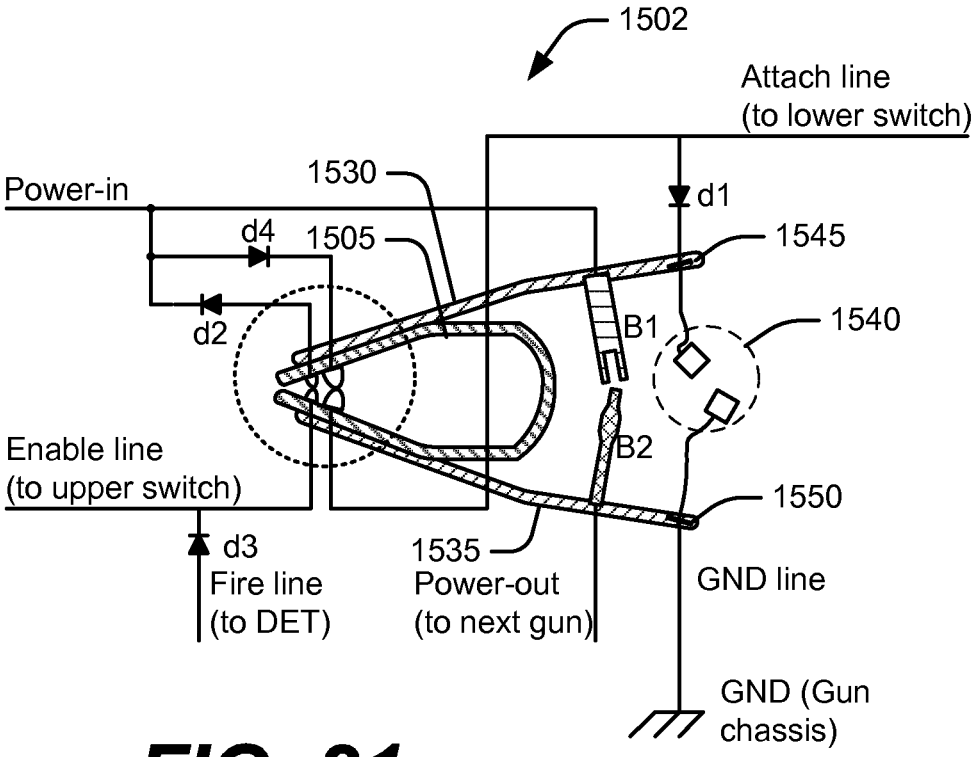
Figure 22:
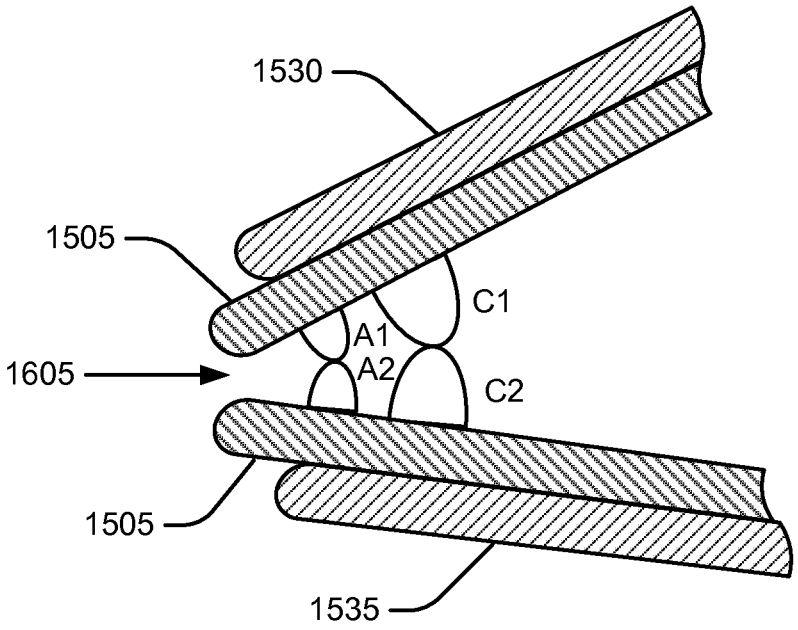

FIGS. 21 and 22 are identical to FIGS. 17 and 18 except that the polarity of the diodes is reversed. FIG. 17 shows a positive switch. FIG. 21 shows a negative switch.

FIG. 23 illustrates an example of a typical use of the fire clip switches shown in FIGS. 15-22 in a downhole wireline perforating gun string. In FIG. 23, each tandem (TN) and its associated gun (GN) constitute a logical element. That is tandem T1 and gun G1 constitute a logical element, as do tandem T2 and gun G2, tandem T3 and gun G3, and tandem T4 and gun G4. It will be understood that the perforating gun string could be extended open-endedly with the addition of tandem/gun logical elements. Note that in FIG. 23 diode d4 is on the opposite side of the C contacts compared to its location in FIGS. 15, 17, 19, and 21. In alternative embodiments, diode d4 can be in either location.

In one embodiment, every tandem includes one fire clip switch. In one embodiment, each tandem/gun logical element has five external connections: Power-in, Power-out, Attach, Enable, and Fire, although the Fire connection is to the detonator, which is part of the tandem/gun logical element. In one embodiment, the fire clip switches are installed alternately; that is, a positive fire clip switch, such as those illustrated in FIGS. 15-18, is followed by a negative fire clip switch, such as those illustrated in FIGS. 19-22, and vice versa. This is shown in FIG. 23, in which T1/G1 includes a positive fire clip switch, T2/G2 includes a negative fire clip switch, T3/G3 includes a positive fire clip switch, and T4/G4 includes a negative fire clip switch.

In one embodiment, the guns are fired from the bottom up with T1/G1 being the bottommost gun in FIG. 23. This is because, in one embodiment, the blast will destroy everything inside the gun, including the switch and the lines running through it.

In one embodiment, the first switch of the bottommost gun T1/G1 is activated by applying a negative power on the Power-in line. The switch in T1/G1 has its Attach line coupled to its Power-out line because there are no guns below it. In this sense, T1/G1 is unique. In all other TN/GN units, the Attach line is coupled to the Enable line of the switch installed below it. Applying negative power to the Power-in line of a positive fire clip switch (or positive power to the Power-in line of a negative fire clip switch) is called "Attach" or "Attachment." Before Attachment there is no path for positive power because the A contacts (A1 and A2) and the C contacts (C1 and C2) are open and because of the blocking action of d1. Attachment causes the structural collapse of the collapsing element 2305, which causes the A contacts and the C contacts to close, the B contacts (B1 and B2) to open, and the circuit through d1 to open.

Once T1/G1 is attached, the detonator 2310 in G1 can be fired using positive power. Upon applying positive power to the Power-in line, current travels through diode d2 in T1/G1 and contacts A in T1/G1 reaching and collapsing the collapsing element 2315 of the T2/G2 switch through diode d1 in T2/G2 and to ground. A path to ground also exists through diode d3 in T1, the T1/G1 Fire line, and the T1/G1 detonator. In one embodiment in which the collapsing element 2315 is a resistor R, the resistance of the switch R in T2/G2 is much smaller than the resistance of the detonator 2310 in T1/G1, so the current through the collapsing element 2315 will be much higher than that flowing through the detonator 2310. When the collapsing element 2315 in T2/G2 collapses, the contacts B in T2/G2 will open and cut off the current flowing so that the power line does not get shorted to ground when the gun G1 is flooded by conductive borehole fluid. An alternative path for positive power still exists through the now-closed C contacts and diode d4. Additionally, R forms a voltage divider with the resistance of the wireline, $R_{WL}$, producing a low voltage on the detonator in T1/G1, insufficient to set it off. This shunting action of the detonator is reinforced by d3. In one embodiment, one or more additional diodes are placed between diode d3 and DET to improve this protection.

In one embodiment, a power Zener diode (not shown) is in series with d3 between d3 and the detonator to guarantee that no current travels through the detonator until the collapsing element in the tandem/gun above has collapsed.

In one embodiment, the collapsing element (e.g., 2305 or 2315) is a diode that collapses structurally and clamps the voltage on the detonator to a fixed low value so that the collapsing element collapses structurally but the detonator is preserved.

Once the collapsing element 2315 in T2/G2 has collapsed, contact B in T2/G2 opens and contacts C in T2/G2 close. Now current will travel into the detonator of T1/G1 through contacts C and diode d4 of T2/G2, triggering the blasting of the primer cord and the perforating charges in the detonator 2310 in T1/G1.

In one embodiment, the opening of the B contacts in T2/G2 prevents short circuiting the Power-in line by conductive well fluid that invades the blasted gun below it. Contacts C in T2/G2 allow power to flow to the collapsing element 2315 in T2/G2 and the detonator 2310 in T1/G1 after contacts B in T1/G1 open while attaching the switch of T2/G2.

This sequence of actions can be applied indefinitely to a perforating gun string with practically any number of guns.

Figure 24:
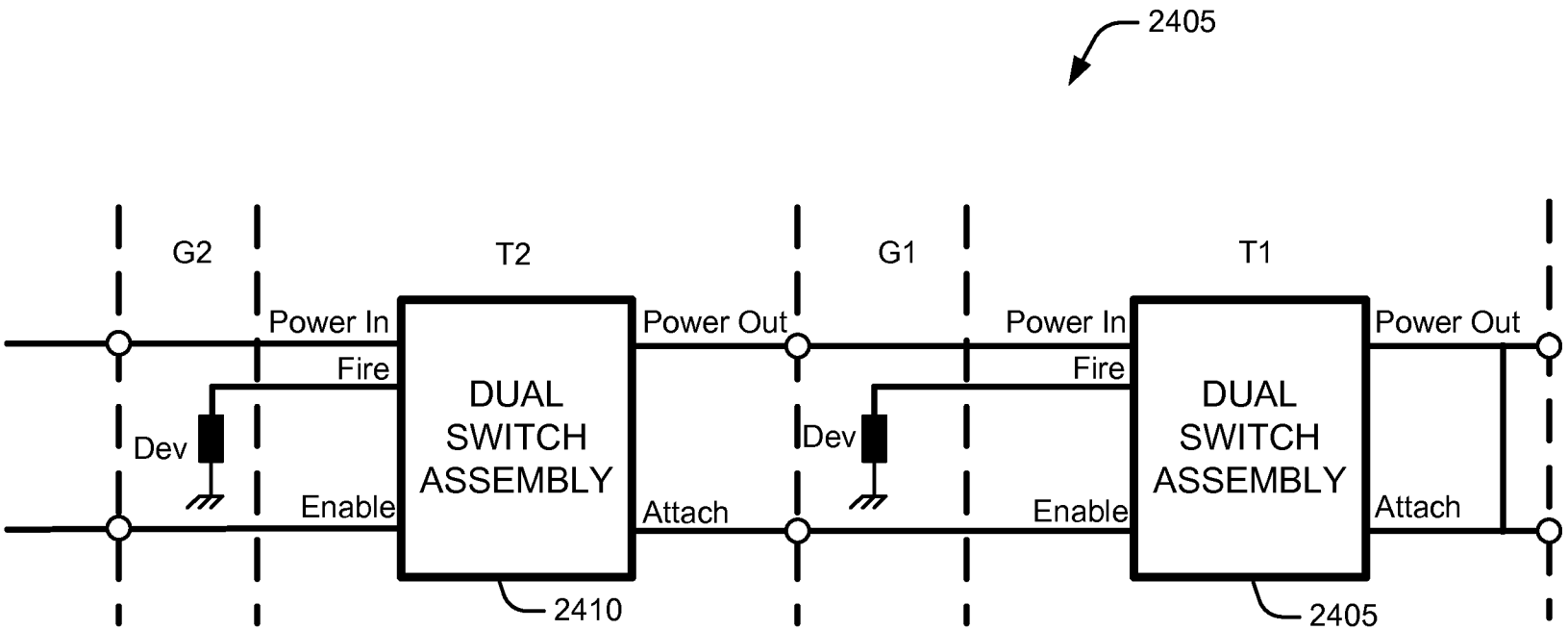
FIG. 24 illustrates a dual switch assembly system.

In one embodiment, illustrated in FIG. 24, each tandem (i.e., T1 and T2 in FIG. 24) includes a dual switch assembly ("DSA") 2405 and 2410. In one embodiment, each dual switch assembly 2405 and 2410 includes two switches of the type illustrated in FIGS. 15-20. In one embodiment, such an arrangement allows the same polarity power to be used for attaching each of the dual switch assemblies 2405 and 2410, the same polarity power to be used for enabling the dual switch assemblies 2405 and 2410, and the same polarity power to be used for firing the detonators.

In one embodiment, shown in FIG. 24, the Power Out line of one dual switch assembly, e.g., the dual switch assembly 2410 in tandem T2, is coupled to the Power In line of the dual switch assembly in the tandem immediately below, e.g., the dual switch assembly 2405 in tandem T1. In one embodiment, power enters a dual switch assembly through the Power In line and is transmitted to another dual switch assembly through the Power Out line. In one embodiment, the Attach line is shorted to the Power Out line in the first (lowest) tandem, i.e., tandem T1, and is used to carry power to attach the dual switch assembly 2405 in T1. In one embodiment, the Enable line from the first dual switch assembly 2405 in tandem T1 is coupled to the Attach line of the dual switch assembly 2410 in tandem T2 and is used to attach that switch. In one embodiment, the Fire line is coupled to the device ("DEV") to be activated. In one embodiment, the device to be activated is a detonator and Fire line is used to detonate the detonator. In one embodiment, the device to be activated is not a destructive device and the Fire line is used to activate the non-destructive device's functionality.

Figure 25:
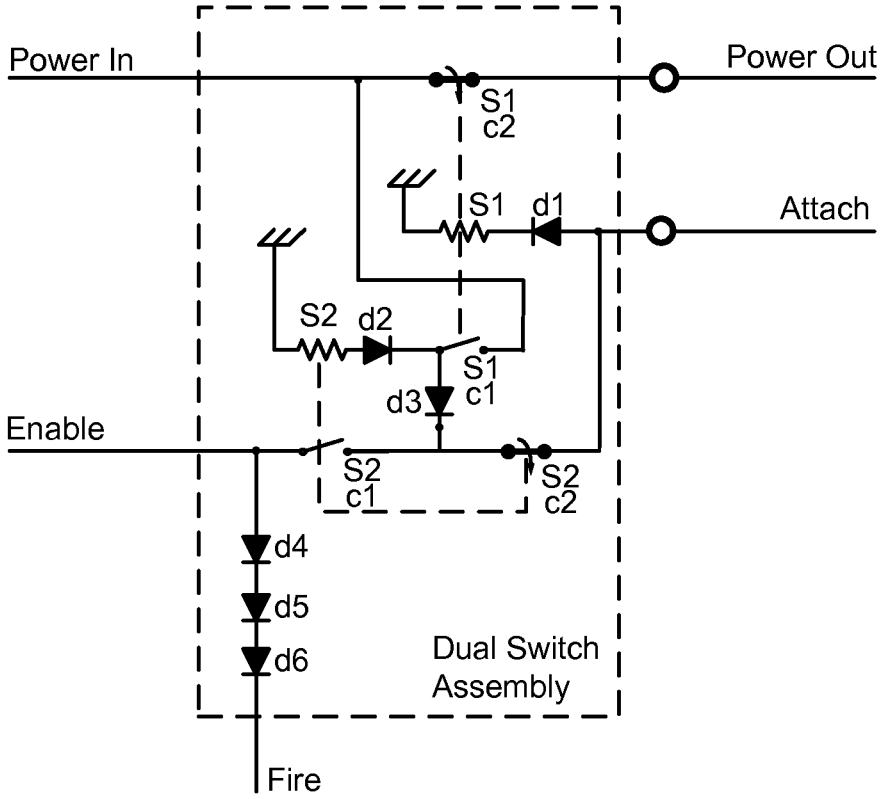
FIG. 25 illustrates a dual switch assembly.

One embodiment of a dual switch assembly, shown in FIG. 25, includes two switches S1 and S2 of the type illustrated in FIGS. 15-20 using only one normally-open set of contacts, e.g. contacts A1 and A2, and one normally-closed set of contacts, e.g. contacts B1 and B2. In one embodiment, switch S1 has a normally open set of contacts, S1*c*1, and a normally closed set of contacts, S1*c*2. In one embodiment, the normally open set of contacts S1*c*1 are similar to contacts A1/A2 or C1/C2 in FIGS. 15-22. In one embodiment, the normally closed set of contacts S1*c*2 is similar to contacts B1/B2 in FIGS. 15-22.

Returning to FIG. 25, in one embodiment, the Power In line is coupled to one side of the normally closed S1*c*2 contacts and to one side of the normally open S1*c*1 contacts. In one embodiment, the other side of the S1*c*2 contacts is coupled to the Power Out line through a hydraulic seal represented by the open circle shown in FIG. 25. In one embodiment, the other side of the S1*c*1 contacts is coupled to the anode of diode d3 and the cathode of diode d2. In one embodiment, the anode of diode d2 is coupled to the activating element, such as the collapsing element 1540 or the restraining element 905 discussed above, of switch S2, represented by the resistor symbol. In one embodiment, the other side of the activating element of switch S2 is coupled to ground. In one embodiment, the cathode of diode d3 is coupled to one side of the normally open S2*c*1 contacts and one side of the normally closed S2*c*2 contacts. In one embodiment, the other side of the S2*c*1 contact is coupled to the Enable line and to the anode of the first of three diodes, d4, d5, and d6, connected in series. In one embodiment, the cathode of diode d6 is coupled to the Fire line. In one embodiment, the other side of the S2*c*2 contacts is coupled to the Attach line through a hydraulic seal and to the anode of diode d1. In one embodiment, the cathode of diode d1 is coupled to the activating element, such as the collapsing element 1540 or the restraining element 905 discussed above, of switch S1, represented by the resistor symbol. In one embodiment, the other side of the activating element of switch S1 is coupled to ground.

In this configuration, in one embodiment, positive power applied to the Power In line flows through the normally closed S1*c*2 contacts to the Power Out line but is blocked from any other components in the switch by the normally open S1*c*1 contacts. In one embodiment, positive power applied to the Attach line flows is blocked by the normally open S2*c*1 contacts and diode d3 but flows through diode d1 and activates switch S1 causing the normally closed S1*c*2 contacts to open and the normally open S1*c*1 contacts to close.

In that configuration, in one embodiment, negative power applied to the Power In line will be blocked by the now-open S1*c*2 contacts but flow through the now-closed S1*c*1 contacts. In one embodiment, that power will be blocked by diode d3 but will flow through diode d2 to activate switch S2 causing the normally open S2*c*1 contacts to close and the normally closed S2*c*2 contacts to open.

In that configuration, in one embodiment, application of positive power to the Power In line will be blocked by the now open S1*c*2 contacts but flow through the now-closed S1*c*1 contacts, through d3, through the now-closed S2*c*1 contacts, through diodes d4, d5, and d6 to the device to be activated (e.g., detonator). In one embodiment, the positive power also flows out the Enable line and attaches another switch, as will be discussed with respect to FIG. 26.

Figure 26:
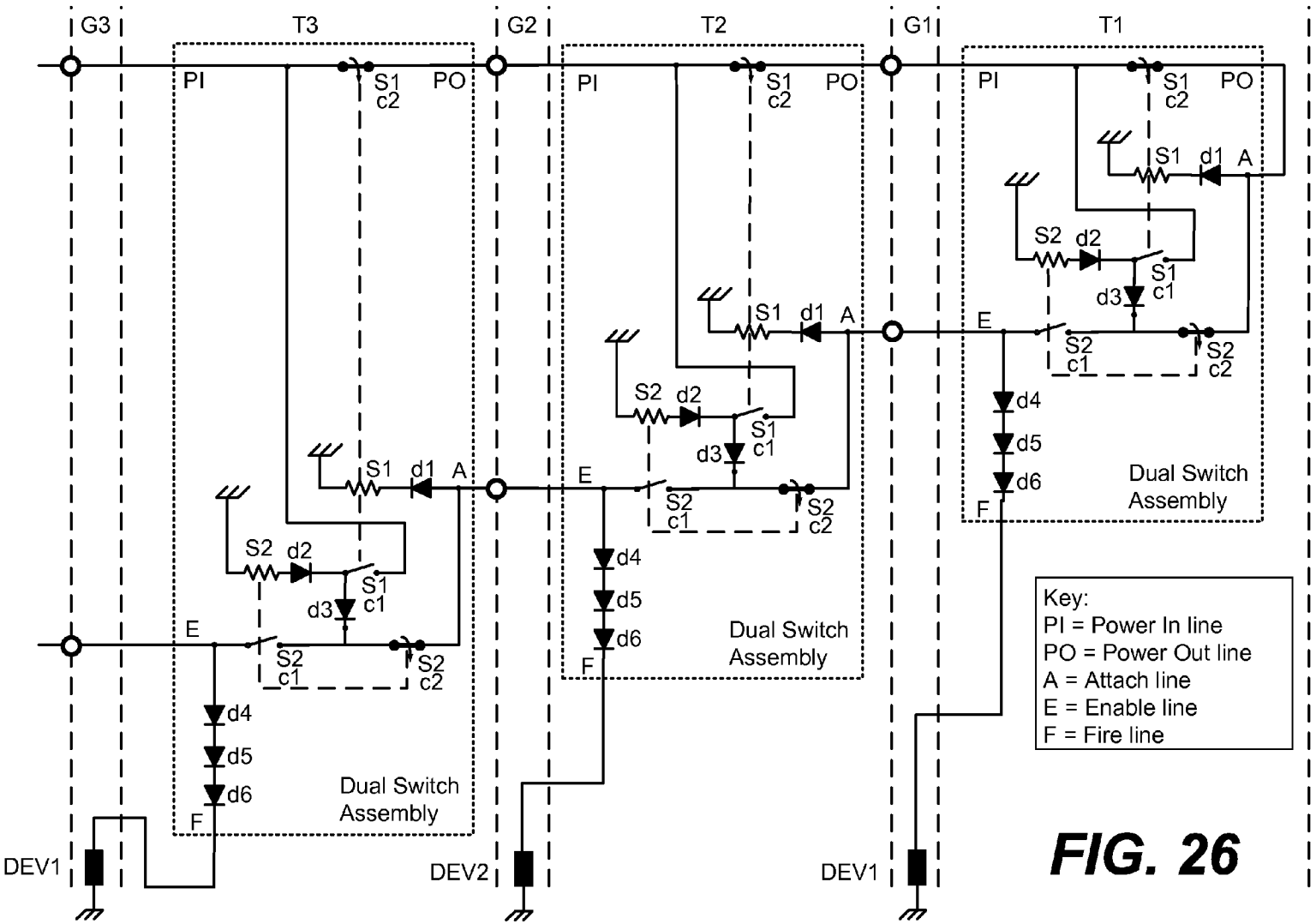
FIG. 26 illustrates a perforating apparatus having three tandems and three guns.

FIG. 26 illustrates one embodiment of a perforating apparatus having three tandems T1, T2, and T3 and three guns, G1, G2, and G3. In one embodiment, each of the three tandems includes a dual switch assembly and each of the tandem/gun combinations (i.e., T1/G1, T2/G2, and T3/G3) has the same polarity scheme. That is, in one embodiment, each attaches with the application of positive power, enables with the application of negative power, and fires with the application of positive power. In one embodiment, reversing the polarities of all of the diodes shown on FIG. 26 would reverse the polarity scheme of the perforating apparatus so that each would attach with the application of negative power, enable with the application of positive power and fire with the application of negative power.

In one embodiment, the Power Out line of each tandem/gun is coupled to the Power In line of the successively lower tandem gun with the exception of the tandem/gun that is lowest in the perforating apparatus (T1/G1, in the example shown in FIG. 26). In one embodiment, the Power Out line of T1/G1 is coupled to its Attach line. In one embodiment, the Attach line of all other tandem/guns is connected to the Enable line of the tandem/gun immediately below it. In one embodiment, the Fire line of each tandem/gun is coupled to the device to be activated by each tandem/gun.

In one embodiment, in the "Attach" process, positive power applied to the Power In line of T3/G3 passes through the normally closed T3-S1*c*2 contacts, the normally closed T2-S1*c*2 contacts, the normally closed T1-S1*c*2 contacts, the T1 Power Out line, the T1 Attach line, T1-d1 and activates T1-S1, opening T1-S1*c*2 and closing T1-S1*c*2.

In one embodiment, in the "Enable" process following the Attach process, negative power applied to the Power In line of T3/G3 passes through the normally closed T3-S1*c*2 contacts, the normally closed T2-S1*c*2 contacts, the now-closed T1-S1*c*1 contacts, T1-d2 and activates T1-S2, closing T1-S2*c*1 and opening T1-S2*c*2.

In one embodiment, in the "Fire" process following the Enable process, positive power applied to the Power In line of T3/G3 passes through the normally closed T3-S1*c*2 contacts, the normally closed T2-S1*c*2 contacts, the now-closed T1-S1*c*1 contacts, the now-closed T1-S2*c*1 contacts and is applied:

through T2-d1 to T2-S1, and through T1-d4, T1-d5, and T1-d6 to DEV1.

In one embodiment, the electrical resistance of the actuating element of T2-S1 is designed to be considerably less than the resistance of DEV1 (in one embodiment the former is 10 percent of the latter; in one embodiment, the former is 5 percent of the latter; in one embodiment, the former is 1 percent of the latter), so that most of the current flowing through T1-S2*c*1 will flow to T2-S1 rather than DEV1. Further, in one embodiment, the diodes T1-d4, T1-d5, and T1-d6 (the actual number of diodes strung in series is variable and a design choice) assures that the voltage across T2-S1 is greater than the voltage across DEV1. In one embodiment, in one embodiment, T2-S1 is designed to actuate at a voltage below the voltage necessary to actuate DEV1. As a result, in one embodiment, T2-S1 will actuate before DEV1 actuates.

In one embodiment, the actuation of T2-S1 opens the normally closed T2-S1*c*2 contacts, which deprives DEV1 of the power it was receiving through T1-S1*c*1 and T1-S2*c*1. However, in one embodiment, T2-S2 is designed such that T2-S1*c*1 closes before T2-S1*c*2 opens. As a result, in one embodiment, positive power is applied to DEV1 through T2-S1*c*1, T2-d3, normally closed T2-S2*c*2 and T1-d4, T1-d5, and T1-d6. In one embodiment, power no longer flows to T1-S1 because of its actuation. Therefore, in one embodiment, all positive power flows to DEV1, causing it to actuate. In one embodiment, the actuation of DEV1 destroys T1/G1 and causes the G1 region to flood. In one embodiment, the now-open T2-S1*c*2 contacts isolate the Power In line from the flooded G1 region.

In one embodiment, the other tandem/guns operate in a similar way.

While the fire clip switches have been described herein in the context of oil well perforation operations, it should be understood that the switches described above could be used in other contexts as well. Further, within the context of oil well perforation operations, the fire switches described herein could be used in actuation of a setting tool.

The word "coupled" herein means a direct connection or an indirect connection.

The text above describes one or more specific embodiments of a broader invention. The invention also is carried out in a variety of alternate embodiments and thus is not limited to those described here. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

The invention claimed is:

1. A switch comprising:

a spring;

a collapsing element;

the spring having a first spring state in which it is being held in tension by a restraining element;

the spring having a second spring state in which it is not being held in tension because the restraining element has failed;

the collapsing element being situated such that when sufficient power is applied to the collapsing element heat from the collapsing element will cause the restraining element to fail;

a first A contact coupled to the spring;

a second A contact coupled to the spring;

the first A contact and the second A contact having a first 1-2 electrical connection state when the spring is in the first spring state; and the first A contact and the second A contact having a second 1-2 electrical connection state different from the first 1-2 electrical connection state when the spring is in the second spring state;

wherein:

the spring is C-shaped, having a first end, a second end, and an arced element coupled to and between the first end and the second end;

the first contact is coupled to the first end of the spring;

the second contact is coupled to the second end of the spring;

a first elongated tension element is provided that has a proximate end coupled to the first end of the spring;

a second elongated tension element is provided that has a proximate end coupled to the second end of the spring;

a first B contact is coupled to a distal end of the first elongated tension element;

a second B contact is coupled to a distal end of the second elongated tension element, such that the first B contact is coupled to the second B contact when the spring is in the first spring state and the first B contact is not coupled to the second B contact when the spring is in the second spring state;

moving the distal end of the first elongated tension element toward the distal end of the second elongated element causes the first end of the spring to separate from the second end of the spring; and the restraining element is coupled between the distal end of the first elongated tension element and the distal end of the second elongated tension element such that the first end of the spring is separated from the second end of the spring.

2. The switch of claim 1 wherein the restraining element is selected from a group consisting of a tie-wrap, a eutectic substance, and the collapsing element.

3. The switch of claim 1 further comprising:

a third contact coupled to the spring;

a fourth contact coupled to the spring;

the third contact and the fourth contact having a first 3-4 electrical connection state when the spring is in the first state; and the third contact and the fourth contact having a second 3-4 electrical connection state different from the first 3-4 electrical connection state when the spring is in the second state.

4. The switch of claim 3 wherein:

the first contact is electrically connected to the second contact in the first 1-2 electrical connection state;

the first contact is electrically isolated from the second contact in the second 1-2 electrical connection state;

the third contact is electrically connected to the fourth contact in the first 3-4 electrical connection state;

the third contact is electrically isolated from the fourth contact in the second 3-4 electrical connection state.

5. The switch of claim 1 wherein:

a portion of the first end of the spring adjacent to where the first contact is coupled is non-conductive to electricity; and a portion of the second end of the spring adjacent to where the second contact is coupled is non-conductive to electricity.

6. The switch of claim 1 further comprising:

a voltage barrier coupled to the first contact.

7. The switch of claim 6 wherein the voltage barrier comprises a spark gap.

8. The switch of claim 1 further comprising:

a verification device coupled to the first contact.

9. The switch of claim 8 wherein the verification device is selected from the group consisting of a fuse and a resistor, the resistance of the resistor being much greater than the resistance of the collapsing element.

10. A method comprising:

coupling a first switch to a Power-in line, the first switch comprising:

a spring;

a collapsing element;

the spring having a first spring state in which it is being held in tension by a restraining element;

the spring having a second spring state in which it is not being held in tension because the restraining element has failed;

the collapsing element being situated such that, when sufficient current of a first polarity is applied to the collapsing element, heat from the collapsing element will cause the restraining element to fail;

a first A contact coupled to the spring;

a second A contact coupled to the spring;

the first A contact and the second A contact having a first 1-2 electrical connection state when the spring is in the first spring state;

the first A contact and the second A contact having a second 1-2 electrical connection state different from the first 1-2 electrical connection state when the spring is in the second spring state;

the first A contact coupled to a first switch Attach line;

the first switch Attach line coupled to the Power-in line;

wherein:

the spring is C-shaped, having a first end, a second end, and an arced element coupled to and between the first end and the second end;

the first A contact is coupled to the first end of the spring;

the second A contact is coupled to the second end of the spring;

a first elongated tension element is provided that has a proximate end coupled to the first end of the spring;

a second elongated tension element is provided that has a proximate end coupled to the second end of the spring;

a first B contact is coupled to a distal end of the first elongated tension element;

a second B contact is coupled to a distal end of the second elongated tension element, such that the first B contact is coupled to the second B contact when the spring is in the first spring state and the first B contact is not coupled to the second B contact when the spring is in the second spring state;

moving the distal end of the first elongated tension element toward the distal end of the second elongated element causes the first end of the spring to separate from the second end of the spring; and the restraining element is coupled between the distal end of the first elongated tension element and the distal end of the second elongated tension element such that the first end of the spring is separated from the second end of the spring; and applying sufficient power of the first polarity through the Power-in line to the first switch Attach line that the restraining element fails and the spring moves from the first spring state to the second spring state.

11. The method of claim 10 further comprising:

coupling the second contact to a second switch Attach line on a second switch; and after applying sufficient power of the first polarity through the Power-in line to the first switch Attach line, directing current of a second polarity opposite the first polarity through the first contact and the second contact to:

a perforating gun; and the second switch Attach line, the second switch being constructed the same as the first switch except that the second switch requires sufficient power of the second polarity to cause a spring in the second switch to change from a first spring state to a second spring state.

12. The method of claim 10 further comprising:

coupling the second contact to a second switch Attach line on a second switch; and after applying sufficient power of the first polarity through the Power-in line to the first switch Attach line, directing current of a second polarity opposite the first polarity through the first contact and the second contact to:

an explosive initiator in a setting tool; and the second switch Attach line, the second switch being constructed the same as the first switch except that the second switch requires sufficient power of the second polarity to cause a spring in the second switch to change from a first spring state to a second spring state.

13. The method of claim 10 wherein:

the first switch further comprises:

a verification device coupled to the first contact; and the method further comprises:

verifying that the restraining element has failed after applying sufficient power of the first polarity to the Power-in line by detecting the presence of the verification device.

14. The method of claim 13 wherein detecting the presence of the verification device comprises measuring an impedance between the Power-in line and a ground and comparing it to a known impedance of the verification device.

15. One or more non-transitory computer-readable media storing computer-executable instructions which, when executed on a computer system, perform a method comprising:

coupling a first switch to a Power-in line, the first switch comprising:

a spring;

a collapsing element;

the spring having a first spring state in which it is being held in tension by a restraining element;

the spring having a second spring state in which it is not being held in tension because the restraining element has failed;

the collapsing element being situated such that, when sufficient current of a first polarity is applied to the collapsing element, heat from the collapsing element will cause the restraining element to fail;

a first A contact coupled to the spring;

a second A contact coupled to the spring;

the first A contact and the second A contact having a first 1-2 electrical connection state when the spring is in the first spring state;

the first A contact and the second A contact having a second 1-2 electrical connection state different from the first 1-2 electrical connection state when the spring is in the second spring state;

the first contact coupled to a first switch Attach line;

the first switch Attach line coupled to the Power-in line;

wherein:

the spring is C-shaped, having a first end, a second end, and an arced element coupled to and between the first end and the second end;

the first A contact is coupled to the first end of the spring;

the second A contact is coupled to the second end of the spring;

a first elongated tension element is provided that has a proximate end coupled to the first end of the spring;

a second elongated tension element is provided that has a proximate end coupled to the second end of the spring;

a first B contact is coupled to a distal end of the first elongated tension element;

a second B contact is coupled to a distal end of the second elongated tension element, such that the first B contact is coupled to the second B contact when the spring is in the first spring state and the first contact is not coupled to the second contact when the spring is in a second spring state;

moving the distal end of the first elongated tension element toward the distal end of the second elongated element causes the first end of the spring to separate from the second end of the spring; and the restraining element is coupled between the distal end of the first elongated tension element and the distal end of the second elongated tension element such that the first end of the spring is separated from the second end of the spring; and applying sufficient power of the first polarity through the Power-in line to the first switch Attach line that the restraining element fails and the spring moves from the first spring state to the second spring state.

16. The computer-readable media of claim 15 wherein the method further comprises:

coupling the second contact to a second switch Attach line on a second switch; and after applying sufficient power of the first polarity through the Power-in line to the first switch Attach line, directing current of a second polarity opposite the first polarity through the first contact and the second contact to:

a perforating gun; and the second switch Attach line, the second switch being constructed the same as the first switch except that the second switch requires sufficient power of the second polarity to cause a spring in the second switch to change from a first spring state to a second spring state.

17. The computer-readable media of claim 15 wherein the method further comprises:

coupling the second contact to a second switch Attach line on a second switch; and after applying sufficient power of the first polarity through the Power-in line to the first switch Attach line, directing current of a second polarity opposite the first polarity through the first contact and the second contact to:

an explosive initiator in a setting tool; and the second switch Attach line, the second switch being constructed the same as the first switch except that the second switch requires sufficient power of the second polarity to cause a spring in the second switch to change from a first spring state to a second spring state.

18. The computer-readable media of claim 15 wherein: the first switch further comprises:

a verification device coupled to the first contact; and the method further comprises:

verifying that the restraining element has failed after applying sufficient power of the first polarity to the Power-in line by detecting the presence of the verification device.

19. The computer-readable media of claim 18 wherein detecting the presence of the verification device comprises measuring an impedance between the Power-in line and a ground and comparing it to a known impedance of the verification device.

* * * * *